US007541063B2

(12) United States Patent
Shintate et al.

(10) Patent No.: US 7,541,063 B2
(45) Date of Patent: Jun. 2, 2009

(54) METHOD FOR FORMING LAYER

(75) Inventors: Tsuyoshi Shintate, Fujimi (JP); Koichi Mizugaki, Suwa (JP); Jun Yamada, Shiojiri (JP)

(73) Assignee: Seiko Epson Corporation (JP)

( * ) Notice: Subject to any disclaimer, the term of this patent is extended or adjusted under 35 U.S.C. 154(b) by 418 days.

(21) Appl. No.: 11/530,583

(22) Filed: Sep. 11, 2006

(65) Prior Publication Data

US 2007/0057992 A1 Mar. 15, 2007

(30) Foreign Application Priority Data

Sep. 12, 2005 (JP) ..... 2005-263438

(51) Int. Cl.
*B05D 5/00* (2006.01)

(52) U.S. Cl. ..... 427/256; 427/258; 427/427.1

(58) Field of Classification Search ..... 427/256, 427/258, 427.1

See application file for complete search history.

(56) References Cited

U.S. PATENT DOCUMENTS

2003/0083203 A1* 5/2003 Hashimoto et al. ..... 505/100
2004/0131782 A1* 7/2004 Hasei et al. ..... 427/337

FOREIGN PATENT DOCUMENTS

| | | |
|---|---|---|
| JP | 2003-121635 | 4/2003 |
| JP | 2003-260406 | 9/2003 |
| JP | 2003-260408 | 9/2003 |
| JP | 2005-034837 | 2/2005 |

* cited by examiner

*Primary Examiner*—Binh X Tran
(74) *Attorney, Agent, or Firm*—Harness, Dickey & Pierce, P.L.C.

(57) ABSTRACT

In a method for forming a layer using a droplet discharging device that discharges droplets from a plurality of nozzles while relatively moving a surface in a first direction with respect to a head including the plurality of nozzles, the method for forming a layer comprises: a) respectively arranging a first droplet on each of two reference regions on the surface and providing two separate patterns corresponding to the two reference regions; b) fixing the two patterns; c) making the surface lyophilic after fixing the two patterns; and d) arranging a second droplet between the two reference regions and connecting the two patterns after making the surface lyophilic.

7 Claims, 16 Drawing Sheets

10A

| | | | | | | | | | | |
|---|---|---|---|---|---|---|---|---|---|---|
| | (2) | | 1 | | 2 | | 1 | | 2 | | 1 |
| | | | | | | | | | | |
| | (4) | | 3 | | 4 | | 3 | | 4 | | 3 |
| | | | | | | | | | | |
| | (2) | | 1 | | 2 | | 1 | | 2 | | 1 |
| | | | | | | | | | | |
| | (4) | | 3 | | 4 | | 3 | | 4 | | 3 |
| | | | | | | | | | | |
| | (2) | | 1 | | 2 | | 1 | | 2 | | 1 |
| | | | | | | | | | | |
| | (4) | | (3) | | (4) | | (3) | | (4) | | (3) |
| | | | | | | | | | | |

METHOD FOR FORMING LAYER

BACKGROUND OF THE INVENTION

1. Technical Field

The present invention relates to a method for forming a layer by inkjet process.

2. Related Art

Formation of a linear pattern using a droplet discharging device is known (refer to JP-A-2005-34837).

JP-A-2005-34837 is an example of related art.

Inkjet process includes a step of arranging fluid material on a surface of an object, using the droplet discharging device. The fluid material is called functional fluid. The droplet discharging device ordinarily includes a head that discharges the functional fluid as droplets and a mechanism that relatively moves the head with respect to the surface to be the subject in a two-dimensional manner. As a result of such a mechanism, the droplets composed of the functional fluid may be arranged in arbitrary positions on the surface.

When coating a surface having an area that is larger than an area over which one droplet wets the surface and spreads so that no gaps are formed, using such an inkjet process, a plurality of droplets are arranged on the surface so that the ranges within which the droplets wet the surface and spread mutually overlap. As a result, a pattern that coats the surface without forming any gaps can be obtained. However, when the surface has repellency against the functional fluid, the force of attraction between mutually adjacent droplets caused by surface tension is stronger than the force of attraction between the surface and the droplets. Therefore, the functional fluid may be locally concentrated. When the functional fluid is concentrated in this way, the surface cannot be coated evenly with the functional fluid. In worst case, a section of the surface is exposed because of lack of functional fluid.

In addition, the head in the droplet discharging device is provided with a plurality of nozzles. Respective discharge paths of the droplets discharged from the plurality of nozzles may vary between nozzles because of manufacturing errors. When a solid pattern is provided using the droplet discharging device, the variations in discharge paths in the direction perpendicular to the scanning direction may influence the success of the formation of the solid pattern.

SUMMARY

An advantage of some aspects of the invention is to provide a method for forming a favorable solid pattern using a droplet discharging device.

A method for forming a layer according to an aspect of the invention uses a droplet discharging device that relatively moves a surface in a first direction with respect to a head including a plurality of nozzles. The droplet discharging device discharges droplets from the plurality of nozzles while moving the surface. The method for forming a layer includes: a) respectively arranging a first droplet on each of two reference regions on the surface and providing two separate patterns corresponding to the two reference regions; b) fixing the two patterns; c) making the surface lyophilic after the second step; and d) arranging a second droplet between the two reference regions and connecting the two patterns after the step c). According to another aspect of the invention, the method for forming a layer may include a step of respectively arranging a third droplet on each of the two patterns fixed at the third step. In addition, according to still another aspect of the invention, the third step can include a step of irradiating ultra-violet rays onto the surface and a step of exposing the surface to plasma.

In this case, the first droplet is fixed onto the surface. Therefore, even if the surface has repellency against the first droplet, the first droplet does not move when the second droplet and the third droplet are overlapped onto the first droplet.

According to still another aspect of the invention, the method of forming a layer further includes e) activating the connected patterns after the fourth step.

In this case, the possibility of a hole being formed in the layer finally acquired from the pattern formed by the arrangement of the droplets is low.

In the above-described method for forming a layer, at least one of the volume of a single second droplet and the volume of a single third droplet differs from the volume of a single first droplet.

A method for forming a layer according to still another aspect of the invention uses a droplet discharging device that relatively moves a surface in a first direction with respect to a head including a plurality of nozzles. The droplet discharging device discharges droplets from the plurality of nozzles while moving the surface. The method for forming a layer includes: a) respectively arranging a first droplet on each of a plurality of reference regions aligned on the surface in an array determined by the first direction and a second direction perpendicular to the first direction and providing a plurality of separate patterns corresponding to the plurality of reference regions; b) fixing the plurality of patterns; c) respectively arranging a second droplet between each of the plurality of reference regions aligned in the second direction and connecting the plurality of patterns in the second direction after the step c); d) respectively arranging a third droplet between each of the plurality of reference regions aligned in the first direction and connecting the plurality of patterns in the first direction after the step c); and e) arranging a fourth droplet between each of the reference regions aligned in a composite direction of the first direction and the second direction after the step d).

In this case, each of the plurality of patterns is fixed onto the respective reference regions. As a result, for example, even if the surface has repellency against the first droplet, the first droplet does not move when the second droplet and the third droplet are overlapped onto the first droplet.

Preferably, the above-described method of forming a layer further includes f) making the surface lyophilic, between the step b) and the step c). The sixth step may include a step of respectively arranging a fifth droplet on each of the plurality of patterns. In addition, the step f) may include a step of irradiating ultraviolet rays onto the surface or a step of exposing the surface to plasma.

One effect acquired in this case is that the second droplet is not pulled towards the plurality of patterns, even when the second droplet is overlapped onto the plurality of patterns that has already been formed.

According to still another aspect of the invention, the method for forming a layer further includes g) activating the patterns after the step e).

In this case, the possibility of a hole being formed in the layer finally acquired from the patterns formed by the arrangement of the droplets is low.

In the above-described method for forming a layer, at least one of the volume of a single second droplet, the volume of a single third droplet, the volume of a single fourth droplet, and the volume of a single fifth droplet may differ from the volume of a single first droplet.

BRIEF DESCRIPTION OF THE DRAWINGS

The invention will be described with reference to the accompanying drawings, wherein like numbers reference like elements.

DESCRIPTION OF EXEMPLARY EMBODIMENT

Embodiments of the invention will now be described with reference to the drawings.

Before describing a method for forming a layer according to the embodiments of the invention, the configuration and the function of a droplet discharging device used in the method for forming a layer will be described.

1. Overall Configuration of Droplet Discharging Device

Figure 1:
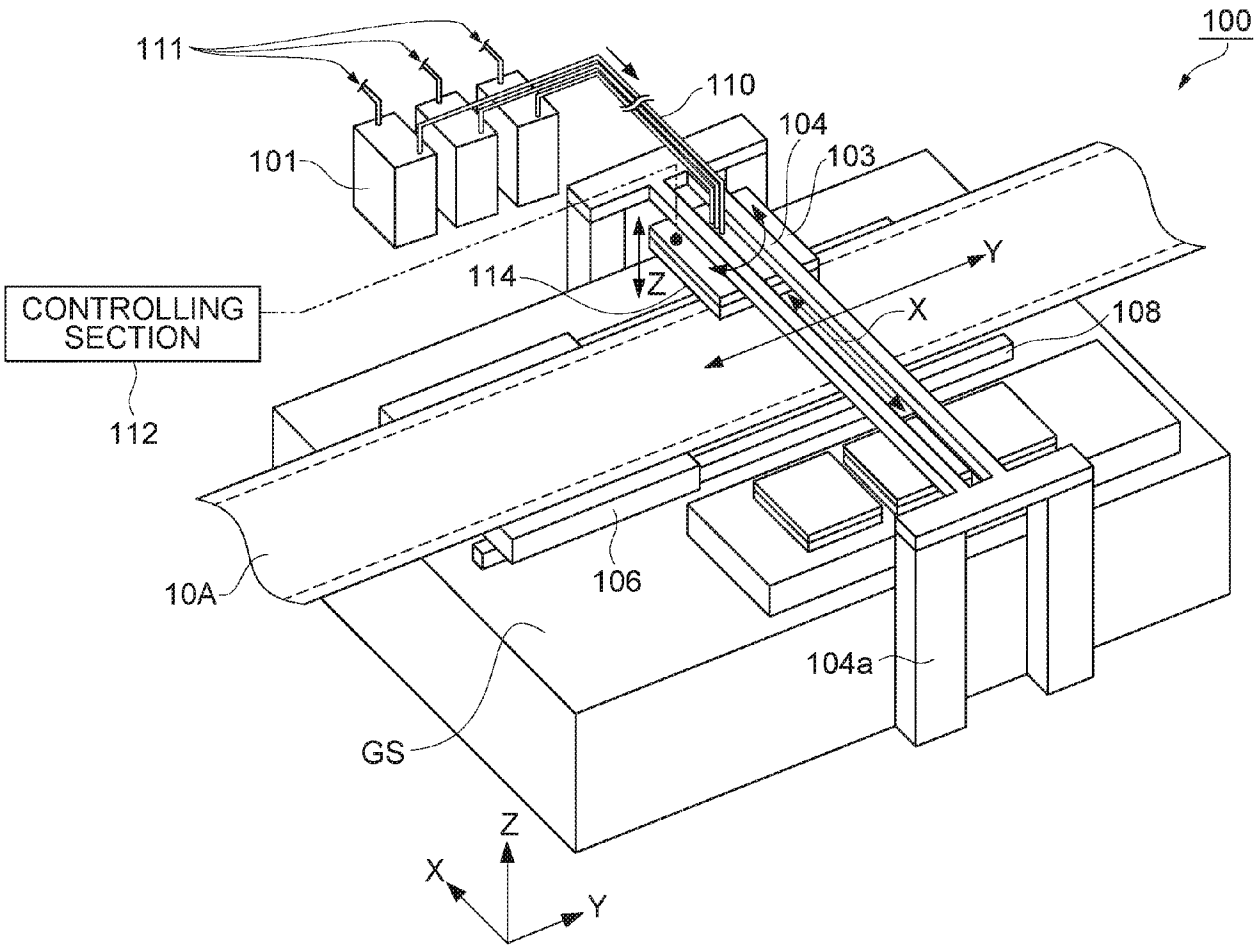
FIG. 1 is a schematic view of a droplet discharging device according to the present embodiment.

A droplet discharging device 100, shown in FIG. 1, is basically an inkjet device. More specifically, the droplet discharging device 100 includes a tank 101 that holds functional fluid 111, a tube 110, a ground stage GS, a discharging head section 103, a stage 106, a first position controlling unit 104, a second position controlling unit 108, a controlling section 112, and a supporting section 104*a*.

Figure 2:
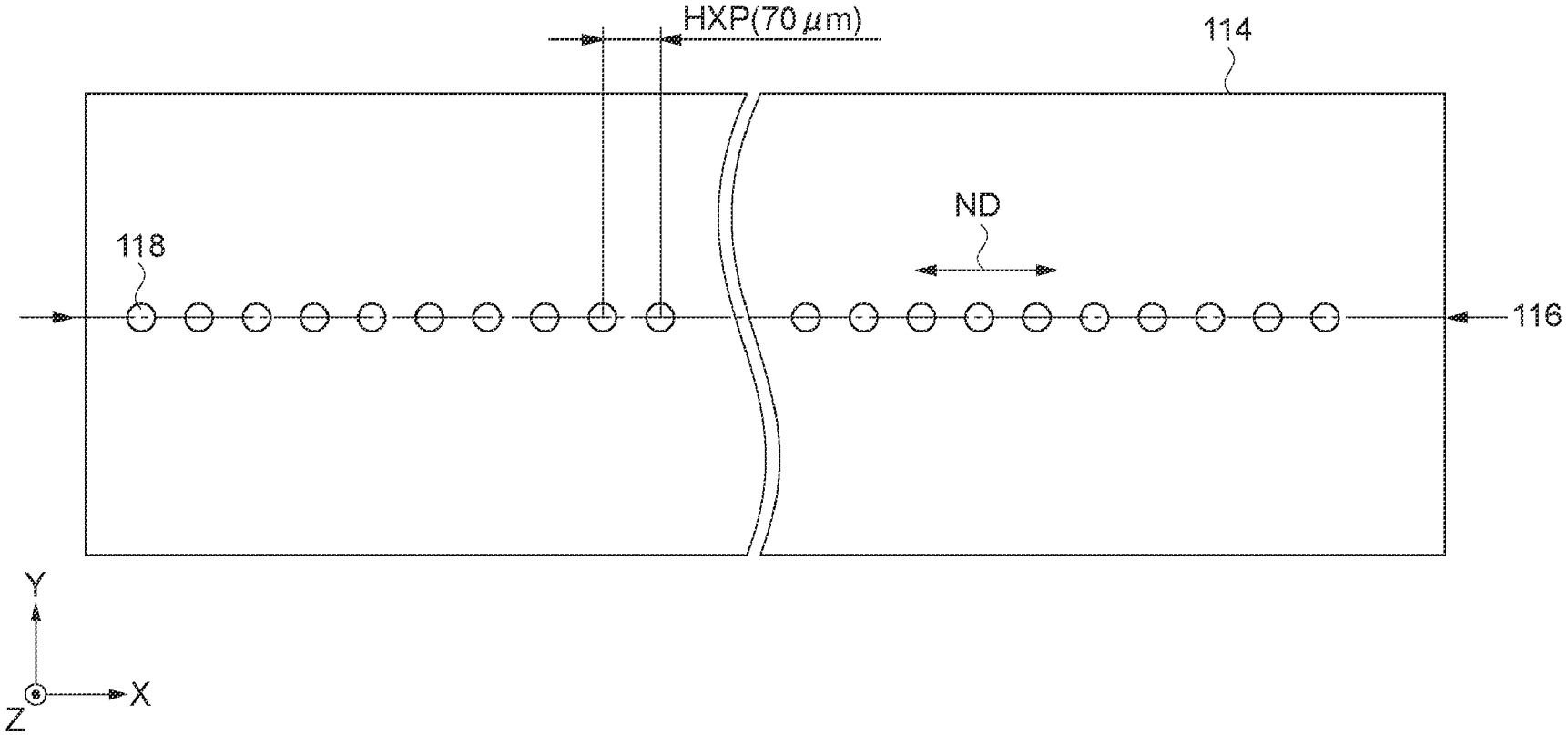
FIG. 2 is a schematic view of a nozzle row on a head in the droplet discharging device.

The discharging head section 103 holds a head 114 (see FIG. 2). The head 114 discharges droplets of the functional fluid 111 depending on a signal from the controlling section 112. The head 114 in the discharging head section 103 is connected to the tank 101 by the tube 110. Therefore, the functional fluid 111 is supplied to the head 114 from the tank 101.

The stage 106 has a flat surface used to secure a substrate 10A. Furthermore, the stage 106 functions to secure the position of the substrate 10A using suction. As described hereafter, the substrate 10A is a flexible substrate composed of polyimide and is tape-shaped. Both ends of the substrate 10A are secured to a pair of reels (not shown).

The first position controlling unit 104 is fixed to a position at a predetermined height from the ground stage GS by the supporting section 104*a*. The first position controlling unit 104 functions to move the discharging head section 103 in an X axis direction and a Z axis direction that is perpendicular to the X axis direction, depending on the signal from the controlling section 112. Furthermore, the first position controlling unit 104 functions to rotate the discharging head section 103 around an axis that is parallel to the Z axis. In this embodiment, the Z axis direction is parallel to the vertical direction (namely, the direction of gravitational acceleration).

The second position controlling unit 108 moves the stage 106 on the ground stage GS in a Y axis direction, depending on the signal from the controlling section 112. The Y axis direction is perpendicular to both the X axis direction and the Z axis direction.

The configurations of the first position controlling unit 104 and the configuration of the second position controlling unit 108 having such functions are actualized using a known XY robot that uses a linear motor and servomotor. Therefore, details of the configurations will be omitted herein. In the present specification, the first position controlling unit 104 and the second position controlling unit 108 are also referred to as a "robot" or a "scanning section".

As described above, the first position controlling unit 104 moves the discharging head section 103 in the X axis direction. Then, the second position controlling unit 108 moves the substrate 10A with the stage 106 in the Y axis direction. As a result, the relative position of the head 114 to the substrate 10A changes. More specifically, because of the operations, the discharging head section 103, the head 114, and nozzles 118 (see FIG. 2) relatively move, or in other words, relatively scan in the X axis direction and the Y axis direction with respect to the substrate 10A, while maintaining a predetermined distance in the Z axis direction. "Relative movement" and "relative scanning" refer to when at least one of the side discharging the functional fluid 111 and the side onto which the discharged functional fluid impacts relatively moves with respect to the other.

In the embodiment, the Y axis direction is the "scanning direction". The "scanning direction" is a direction in which at least one of the head 114 and the stage 106 relatively moves with respect to the other. The "scanning direction" is defined as a direction that differs from a "nozzle row direction ND (see FIG. 2)", described hereafter. According to the definition, depending on the direction of the nozzle row direction ND and the configuration of the scanning section, the X axis direction may be the "scanning direction", and the X axis direction and the Y axis direction may respectively be the "scanning direction".

The controlling section 112 is configured to receive discharging data from an external information processing device. The discharging data indicates a relative position to which a droplet D of the functional fluid 111 (see FIG. 3) should be discharged. The controlling section 112 stores the discharging data in an internal memory device. In addition, the controlling section 112 controls the first position controlling unit 104, the second position controlling unit 108, and the head 114, depending on the stored discharging data. In the embodiment, the discharging data is in a bitmap format.

The droplet discharging device 100, having the above-described configuration, relatively moves the nozzles 118 on the head 114 (see FIG. 2) with respect to the substrate 10A, depending on the discharging data. In addition, the droplet discharging device 100 discharges the functional fluid 111 from the nozzle 118 towards the substrate 10A. The relative movement of the head 114 by the droplet discharging device 100 and the discharging of the functional fluid 111 from the head 114 may be collectively referenced to as a "discharge scanning".

B. Head

The head 114, shown in FIG. 2, is one of a plurality of heads 114 provided in the discharging head section 103. FIG. 2 is a view of the head 11.4 from the stage 106 side. FIG. 2 shows the bottom surface of the head 114. The head 114 has a nozzle row 116 that extends in the X axis direction. The nozzle row 116 is composed of a plurality of nozzles 118 that are almost evenly aligned in the X axis direction. The plurality of nozzles 118 are arranged so that the nozzle pitch HXP in the X axis direction is approximately 70 μm. Here, the "nozzle pitch HXP in the X axis direction" is equivalent to the pitch between a plurality of nozzle images acquired by projecting an image of all nozzles 118 on the head 114 from a direction perpendicular to the X axis direction to the X axis.

Here, the direction in which the nozzle row 116 is extended is referred to as the "nozzle row direction ND". The nozzle row direction ND in the embodiment is parallel to the X axis direction. Therefore, the nozzle row direction ND is perpendicular to the Y axis direction. However, in other embodiments, the nozzle row direction ND may differ from both the X axis direction and the Y axis direction. In addition, the number of nozzles 118 in the nozzle row 116 is 180 nozzles. However, the number of nozzles 118 on a single head 114 is not limited to 180 nozzles. For example, a single head 114 can have 360 nozzles.

Figure 3A:
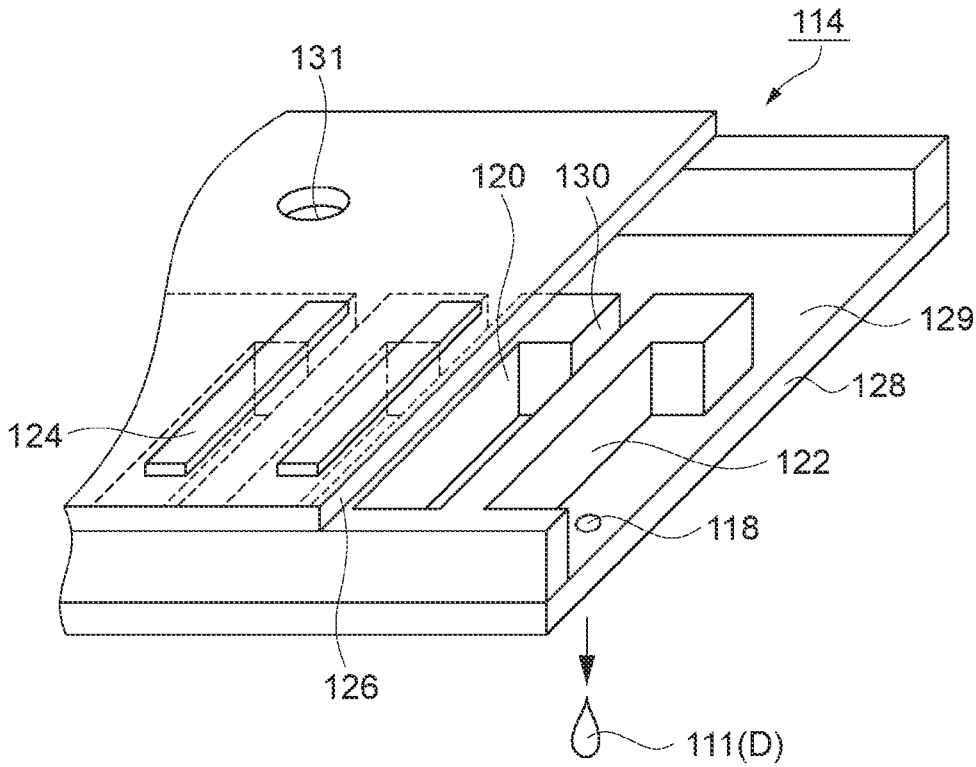
FIGS. 3A and 3B are schematic views of a configuration of the head.
Figure 3B:
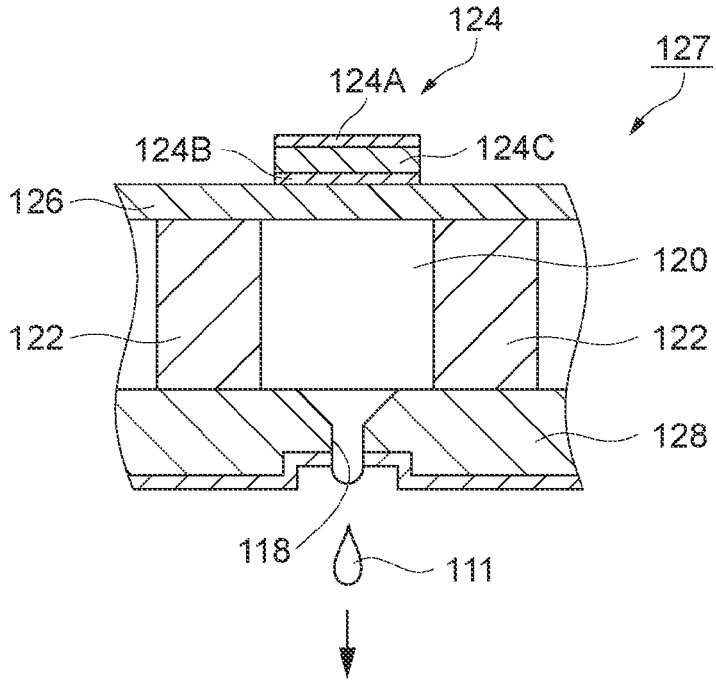

As shown in FIGS. 3A and 3B, each head 114 is an inkjet head. More specifically, each head 114 includes a vibrating plate 126, a nozzle plate 128 provided with a plurality of nozzles, a fluid reservoir 129, a plurality of partition walls 122, a plurality of cavities 120, and a plurality of vibrators 124. The fluid reservoir 129 is positioned between the vibrating plate 126 and the nozzle plate 128. The fluid reservoir 128 is always filled with the functional fluid 111 that is supplied from the tank 101 (see FIG. 1) via a hole 131.

In addition, the plurality of partition walls 122 is positioned between the vibrating plate 126 and the nozzle plate 128. A section surrounded by a pair of partition walls 122, the vibrating plate 126, and the nozzle plate 128 is the cavity 120. The cavity 120 is provided in correspondence with the nozzle 118. Therefore, the number of cavities 120 and the number of nozzles 118 are the same. The functional fluid 111 is supplied to the cavity 120 from the fluid reservoir 129, via a supply opening 130 positioned between the pair of partition walls 122.

The vibrator 124 is positioned on the vibrating board 126 so as to correspond with the respective cavities 120. As shown in FIG. 3B, the vibrator 124 includes a piezo element 124C and a pair of electrodes 124A and 124B. The pair of electrodes 124A and 124B sandwich the piezo element 124C. The functional fluid 111 is discharged from the corresponding nozzle 118 by a driving voltage being applied between the pair of electrodes 124A and 124B. The shape of the nozzle 118 is adjusted so that the functional fluid 111 is discharged from the nozzle 118 in the Z axis direction.

In the present specification, a section including one nozzle 118, the cavity 120 corresponding to the nozzle 118, and the vibrator 124 corresponding to the cavity 120 may be referred to as a "discharging section 127". According to this, a single head 114 has the same number of discharging sections 127 as the number of nozzles 118. The discharging section 127 may have an electrothermal converter in place of the piezo element. In other words, the discharging section 127 may be configured to discharge the functional fluid 111 using heat expansion of materials caused by the electrothermal converter.

C. Controlling Section

Figure 4:
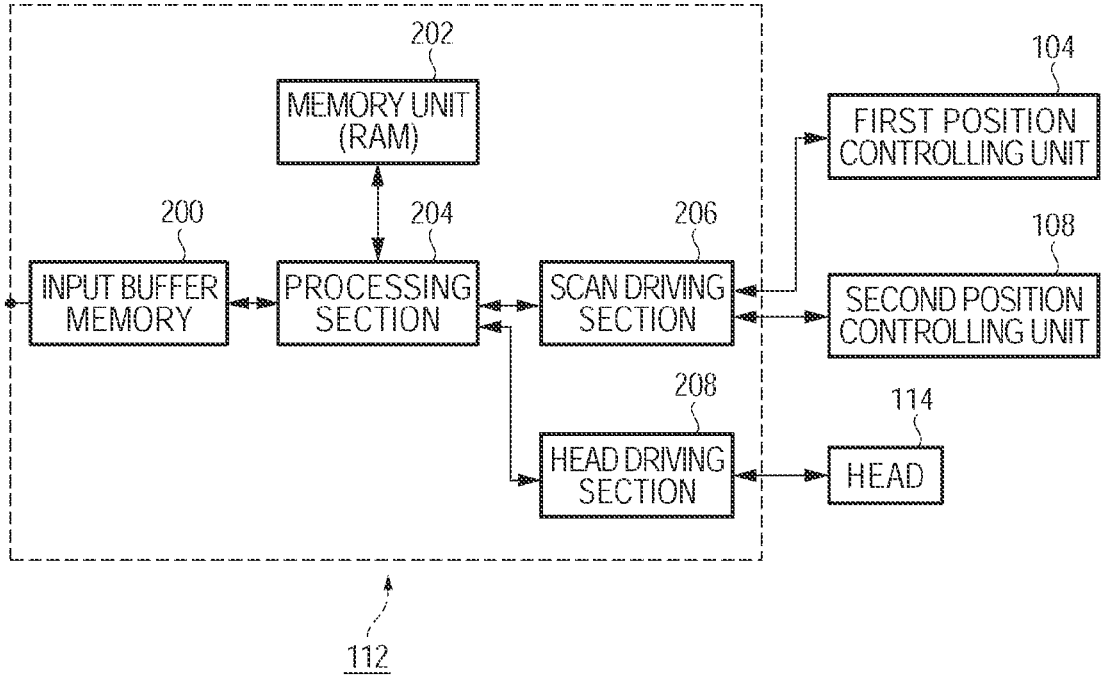
FIG. 4 is a functional diagram showing a controlling section in the droplet discharging device.

Next, a configuration of the controlling section 112 will be described with reference to FIG. 4. The controlling section 112 includes an input buffer memory 200, a memory unit 202, a processing section 204, a scan driving section 206, and a head driving section 208. The input buffer memory 200, the processing section 204, the memory unit 202, the scan driving section 206, and the head driving section 208 are connected by a bus (not shown) to allow communication therebetween. In addition, the scan driving section 206 is connected to the first position controlling unit 104 and the second position controlling unit 108 to allow communication therebetween. Similarly, the head driving section 208 is connected to each of the plurality of heads 114 to allow communication therebetween.

The input buffer memory 200 receives the discharging data from a computer (not shown) positioned outside of the droplet discharging device 100. The discharging data is used to discharge the droplet D of the functional fluid 111. The input buffer memory 200 supplies the processing section 204 with the discharging data. The processing section 204 stores the discharging data in the memory unit 202. In FIG. 4, the memory unit 202 is a random-n access memory (RAM).

The processing section 204 provides the scan driving section 206 with data indicating the relative position of the nozzle 118 to the substrate 10A, based on the discharging data within the memory unit 202. The scan driving section 206 provides the second position controlling device 108 with a stage driving signal, depending on the data and discharging cycle EP (see FIG. 5B), described hereafter. As a result, the head 114 performs a relative scan on the substrate 10A. At the same time, the processing section 204 provides the head driving section 208 with a selection signal SC(i) (see FIG. 5B), based on the discharging data stored in the memory unit 202. As a result, the droplet D of the functional fluid 111 is discharged from the corresponding nozzle 118 on the head 114.

The controlling section 112 is a computer including a central processing unit (CPU), a read-only memory (ROM), a RAM, an external interface section and a bus. The bus connects the CPU, the ROM, the RAM, and the external interface section to allow communication therebetween. Therefore, the functions of the controlling section 112 are actualized by the CPU executing a software program stored in the ROM or the RAM. The controlling section 112 can also be actualized by a dedicated circuit (hardware).

Next, a configuration and function of the head driving section 208 in the controlling section 112 will be described, with reference to FIG. 5A and FIG. 5B.

Figure 5A:
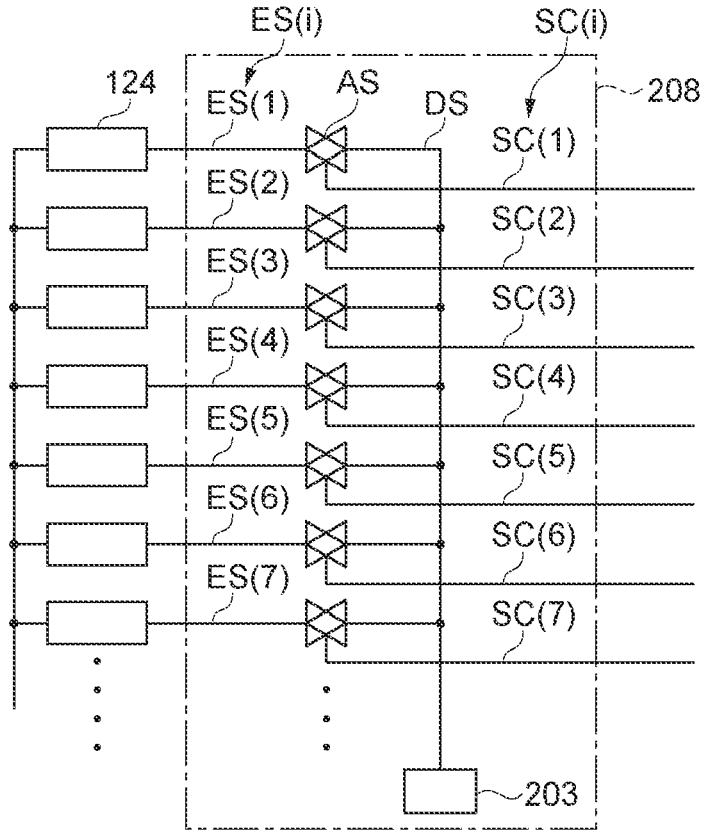
FIG. 5A is a schematic view of a head driving section in the controlling section.

As shown in FIG. 5A, the head driving section 208 includes one driving signal generating section 203 and a plurality of analog switches AS. As shown in FIG. 5B, the driving signal generating section 203 generates the driving signal DS. The electrical potential of the driving signal DS temporally changes from a reference potential L. Specifically, the driving signal DS includes a plurality of discharge waveforms P that are repeated by the discharging cycle EP. Here, the discharging waveform P corresponds to a waveform of a driving voltage to be applied to the corresponding vibrator 124 (see FIG. 3) to discharge a single droplet D from the nozzle 118.

The driving signal DS is provided to each input terminal of the analog switch AS. Here, each analog switch AS is provided to correspond to each discharging section 127.

The processing section 204 (see FIG. 4) provides each analog switch AS with the selection signal SC(i) indicating ON and OFF of the nozzle 118. Here, the selection signal SC(i) may be individually held "high" or "low" for each analog switch AS. At the same time, the analog switch AS provides the electrode 124A of the vibrator 124 with a discharge signal ES(i), depending on the driving signal DS and the selection signal SC(i). Specifically, when the selection signal SC(i) is held "high", the analog switch AS transmits the driving signal DS to the electrode 124A as the discharging signal ES(i). At the same time, when the selection signal SC(i) is held "low", the electrical potential of the discharging signal ES(i) outputted from the analog switch AS is the reference potential L. When the driving signal DS is provided to the electrode 124A of the vibrator 124, the functional fluid 111 is discharged from the nozzle 118 corresponding to the vibrator 124. The reference potential L is applied to the electrode 124B of each vibrator 124.

Figure 5B:
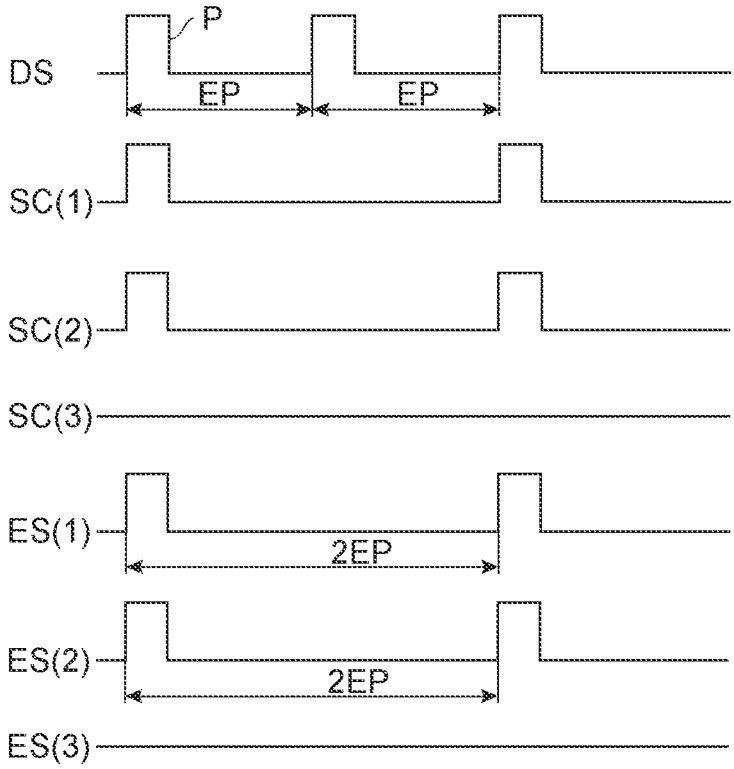
FIG. 5B is a timing chart that shows a selection signal, a driving signal, and a discharging signal.

In the example shown in FIG. 5B, a "high"-level period and a "low"-level period are set for each of the two selection signals SC(1) and SC(2) so that the discharging waveform P appears at a cycle 2EP. The cycle 2EP is twice the discharge cycle EP. As a result, the functional fluid 111 is discharged from each of the two corresponding nozzles 118 at the cycle 2EP. Here, a common driving signal DS from a common driving signal generating section 203 is provided to each vibrator 124 corresponding to the two nozzles 118. Therefore, the functional fluid 111 is discharged from the two nozzles 118 almost simultaneously. The corresponding selection signal SC(3) is continuously held "low" so that no driving waveforms P appear in the discharging signal ES(3) in FIG. 5B.

As a result of the above-described configuration, the droplet discharging device 100 arranges the droplets D, composed of the functional fluid 111, on the surface of the substrate 10A, depending on the discharging data provided to the controlling section 112.

D. Method for Forming Layer

The method for forming a layer according to the embodiment will be explained in detail. According to the method for forming the layer, described hereafter, the droplets D are arranged on the surface of the substrate 10A (see FIG. 6) and a solid pattern 7 is provided (see FIG. 14). Furthermore, the solid pattern 7 is activated and a solid electrical conducting layer 8 (see FIG. 15) is finally acquired. Here, a step of arranging the droplets D using the method for forming a layer is performed by the droplet discharging device 100.

1. Block

Figure 6:
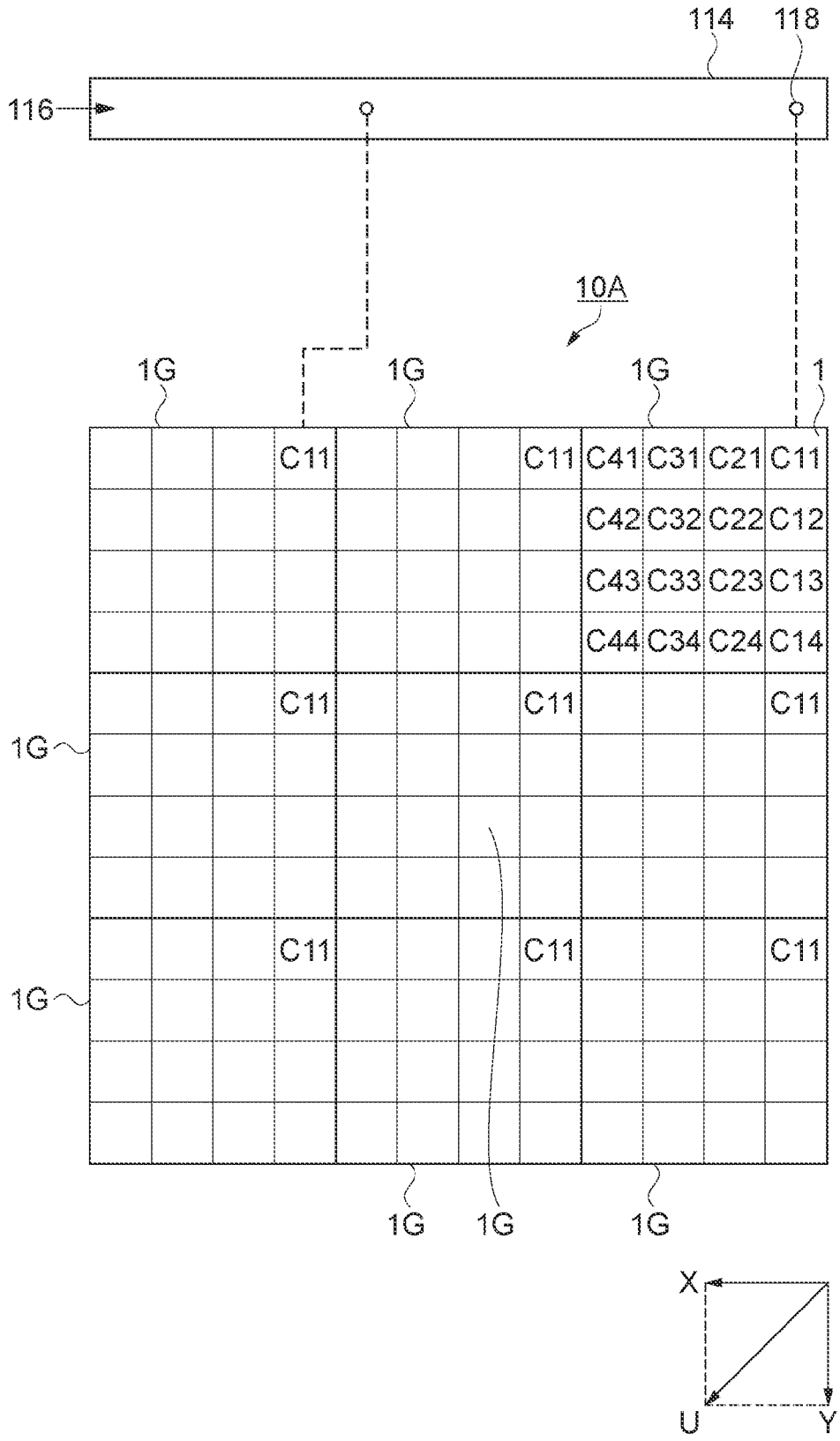
FIG. 6 is a schematic view of a block corresponding to a surface of a substrate.

First, as shown in FIG. 6, a plurality of virtual blocks 1 is assigned to a range, within the surface of the substrate 10A, upon which at least the electrical conducting layer 8 (see FIG. 15) is formed. The plurality of blocks 1 is aligned in an array determined in the X axis direction and the Y axis direction. Here, the length of each of the plurality of blocks 1 along the X axis direction is respectively 11 μm. The length along the Y axis direction is respectively 15 μm. Hereafter, the range within which the electrical conducting layer 8 is to be formed is also referred to as a "layer formation range".

Each of the plurality of blocks 1 is a region in which the droplet D may be arranged. In the embodiment, when the droplet D is arranged on a certain block 1, the droplet D is arranged so that the center of the block 1 and the center of the droplet D to be arranged almost match. Here, the pitch of the plurality of blocks 1 in the X axis direction corresponds to a minimum distance between the centers of two droplets D adjacent in the X axis direction. Similarly, the pitch of the plurality of blocks 1 in the Y axis direction corresponds to a minimum distance between the centers of two droplets D adjacent in the Y axis direction. In FIG. 6, in order to simplify the description, 144 (12×12) blocks 1 are shown. However, in actuality, the number of blocks 1 is not limited thereto.

A block group 1G is defined for each set of 16 blocks 1, determined by 4 blocks×4 blocks. Then, for the purpose of identifying each of the 16 blocks 1 in one block group 1G, each of the 16 blocks 1 is expressed by a reference number including the letter "C" and a two-digit suffix (for example, C11). The right-hand side value of the suffix indicates the position in the block group 1G along the Y axis direction. The value is an integer from 1 to 4. At the same time, the left-hand side value of the suffix indicates the position in the block group 1G along the X axis direction. The value is an integer from 1 to 4.

Focusing on a plurality of C11, the plurality of C11 is aligned in an array determined in the X axis direction and the Y axis direction on the surface of the substrate 10A. In other words, the plurality of C11 configures an array. Specifically, the plurality of C11 is positioned periodically in the X axis direction, the Y axis direction, and in the composite direction U of the X axis direction and the Y axis direction. In the embodiment, the distance between two arbitrary C11 that are adjacent in the X axis direction is always 44.0 μm. In addition, the distance between two arbitrary C11 that are adjacent in the Y axis direction is always 60.0 μm. Furthermore, the distance between two arbitrary C11 that are adjacent in the composite direction V of the X axis direction and the Y axis direction is always 74.4 μm. The composite direction U of the X axis direction and the Y axis direction is the direction of a diagonal line going through the block 1.

A plurality of C31 is also aligned in an array determined in the X axis direction and the Y axis direction, as is the plurality of C11. Other types of blocks 1 (namely, C13 and C33) are also aligned in the same way as C11. In other words, the layer formation range includes an array composed of a plurality of C11, an array composed of a plurality of C31, an array composed of a plurality of C13, and an array composed of a plurality of C33.

2. Functional fluid

Here, the step of providing the electrical conducting layer 8 includes a step of arranging the droplet D of the functional fluid 111. The "functional fluid" refers to a fluid material having viscosity so that the fluid material can be discharged from the nozzle 118 of the droplet discharging device 100 as the droplet D. The "functional fluid" can be water based or oil based. The "functional fluid" requires only a sufficient amount of liquidity (viscosity) to allow the "functional fluid" to be discharged from the nozzle 118. As long as the "functional fluid" as a whole is a fluid, solid materials can be included therein. The viscosity of the "functional fluid" is preferable 1 mPa·s or more and 50 mPa·s or less. When the viscosity is 1 mPa·s or more, the surrounding sections of the nozzle 118 are not easily contaminated when the droplet D of the "functional fluid" is discharged. At the same time, when the viscosity is 50 mPa·s or less, frequency of clogging in the nozzle 118 is low, and therefore, a smooth discharging of the droplet D can be actualized.

The functional fluid 111 of the embodiment includes carrier fluid and silver that serves as an electrical conducting material. Here the silver in the functional fluid 111 is in the form of silver particles. The average particle size of the silver particle is approximately 10 nm. In the functional fluid, the silver particles are coated with a coating agent. The silver particles that are coated with the coating agent are stably dispersed within the carrier fluid. Particles having an average particle size of approximately 1 nm to several 100 nm are also referred to as "nano particles". According to this, the functional fluid includes silver nano particles.

The carrier fluid (or solvent) is not particularly limited as long as the carrier fluid can disperse electrical conducting fine particles, such as silver particles, and does not cause coagulation. For example, in addition to water, the carrier fluid may be alcohols, hydrocarbon compounds, ethereal compounds, and polar compounds. Methanol, ethanol, propanol, butanol, and the like may be given as examples of alcohols. N-heptane, n-octane, decane, dodecane, tetradecane, toluene, xylene, cymene, edulen, inden, dipentene, tetrahydronaphthalene, decahydronaphthalene, cyclohexylbenzene, and the like may be given as examples of hydrocarbon compounds. Ethylene glycol dimethyl ether, ethylene glycol diethyl ether, ethylene glycol methylethyl ether, diethylene glycol dimethyl ether, diethylene glycol diethyl ether, diethylene glycol methylethyl ether, 1,2-dimethoxy-ethane, bis(2-methoxyethyl ether, p-dioxane, and the like may be given as examples of ethereal compounds. Propylene carbonate, γ-butyrolactone, N-methyl-2-pyrrolidone, dimethyl formamide, dimethyl sulfoxide, cyclohexanone, and the like can be given as examples of polar compounds. Among these, water, alcohols, hydrocarbon compounds, and ethereal compounds are preferable from the perspective of dispersibility of electric conducting fine particles, stability of dispersion liquid, and easy application to the inkjet process. Water and hydrocarbon compounds can be given as more preferable carrier fluids.

In addition, the above-mentioned coating agent is a compound that may be coordinated to a silver atom. Amine, alcohol, thiol, and the like are known as coating agents. More specifically, amine compounds, alkylamines, ethylenediamine, alkyl alcohols, ethylene glycol, propylene glycol, alkythiols, ethanedithiol and the like are used as coating agents. Amine compounds include 2-methylaminoethanol, diethaniolamine, diethylmethylamine, 2-dimethylaminoethanol, methyldiethanolamine, and the like. The silver nano particles coated with the coating agent may be dispersed within the carrier fluid with more stability.

3. Droplet Arrangement Order

Figure 7:
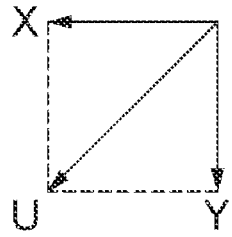
FIG. 7 is a diagram showing an order in which droplets are arranged on the blocks.

Hereafter, a solid pattern that is continuous in the X axis direction, the Y axis direction, and the composite direction U is provided within a layer formation range corresponding to 9 blocks×9 blocks, with the upper-right block 1 in FIG. 7 as the reference. The "solid pattern" described herein is the layer that becomes the electrical conducting layer 8 after an activation step, described hereafter, is performed. The arranged droplet wets the surface and spreads slightly on the surface. Therefore, the area of the layer formation range corresponding to 9 blocks×9 blocks is slightly larger than the area of 9 blocks×9 blocks.

In other embodiments, the layer formation range may correspond to a size other than 9 blocks×9 blocks. For example, the layer formation range may be a range corresponding to 100 blocks×100 blocks or a range corresponding to 1 block×5 blocks. However, the layer formation range is set so that 1) the row or column including C11 corresponds to the outermost side of the layer formation range, and/or 2) C11 corresponds to a corner of the layer formation range. "Row" refers to a set of blocks 1 that are aligned in a row in the X axis direction. "Column" refers to a set of blocks 1 that are aligned in a row in the Y axis direction.

With reference to FIG. 7, a step of arranging the droplet D within the layer formation range will be described. Here, in each of the plurality of block groups 1G (see FIG. 6), the order in which the droplets D are arranged is the same. Specifically, as shown in FIG. 7, in each of the plurality of block groups 1G, the order in which the droplets D are arranged is from C11, C31, C13, to C33.

However, in the block group 1G positioned in the upper-left and the block group 1G positioned in the center-left in FIG. 7, although C11 and C13 correspond to the layer formation range, C31 and C33 do not correspond to the layer formation range. Therefore, the arrangement of droplets in C31 and C33 is skipped in these block groups 1G. Similarly, in the block group 1G in the lower-left in FIG. 7, although C11 corresponds to the layer formation range, C31, C13, and C33 do not correspond to the layer formation range. Therefore, the arrangement of droplets in C31, C13, and C33 is skipped in this block group 1G. Furthermore, in the block group 1G positioned in the lower-center and the block group 1G positioned in the lower-light in FIG. 7, although C11 and C31 correspond to the layer formation range, C13 and C33 do not correspond to the layer formation range. Therefore, the arrangement of droplets in C13 and C33 is skipped in these block groups 1G.

3A. Base Dot Arrangement Step

First, at least one of the size of the block 1, the number of blocks 1 included in the block group 1G, and the impact diameter of the droplet D is adjusted so that the arranged droplets D are connected in a direction that is perpendicular to the scanning direction (N axis direction) and a line-shaped pattern 5 (see FIG. 10) is acquired. In the embodiment, as a result of the adjustment, the size of the block 1 is set to 11 μm×15 μm and the number of blocks 1 included in one block group 1G is 16 blocks, as described above.

In such a block 1 and block group 10, the impact diameter of the droplet D is set to 30 μm. The impact diameter may also be considered as the diameter of a range within which the droplet D arranged on the substrate 10A wets the substrate 10A and spreads on the substrate 10A. Here, the shape of the droplet D immediately after being discharged from the nozzle 118 is almost axisymmetrical in relation to the discharging direction. Therefore, the shape of the range of the droplet D after impact on the substrate 10A is almost circular. In the specification, the droplet D or the range of the droplet D that is impacted onto the substrate 10A is also referred to as a "dot".

Figure 8:
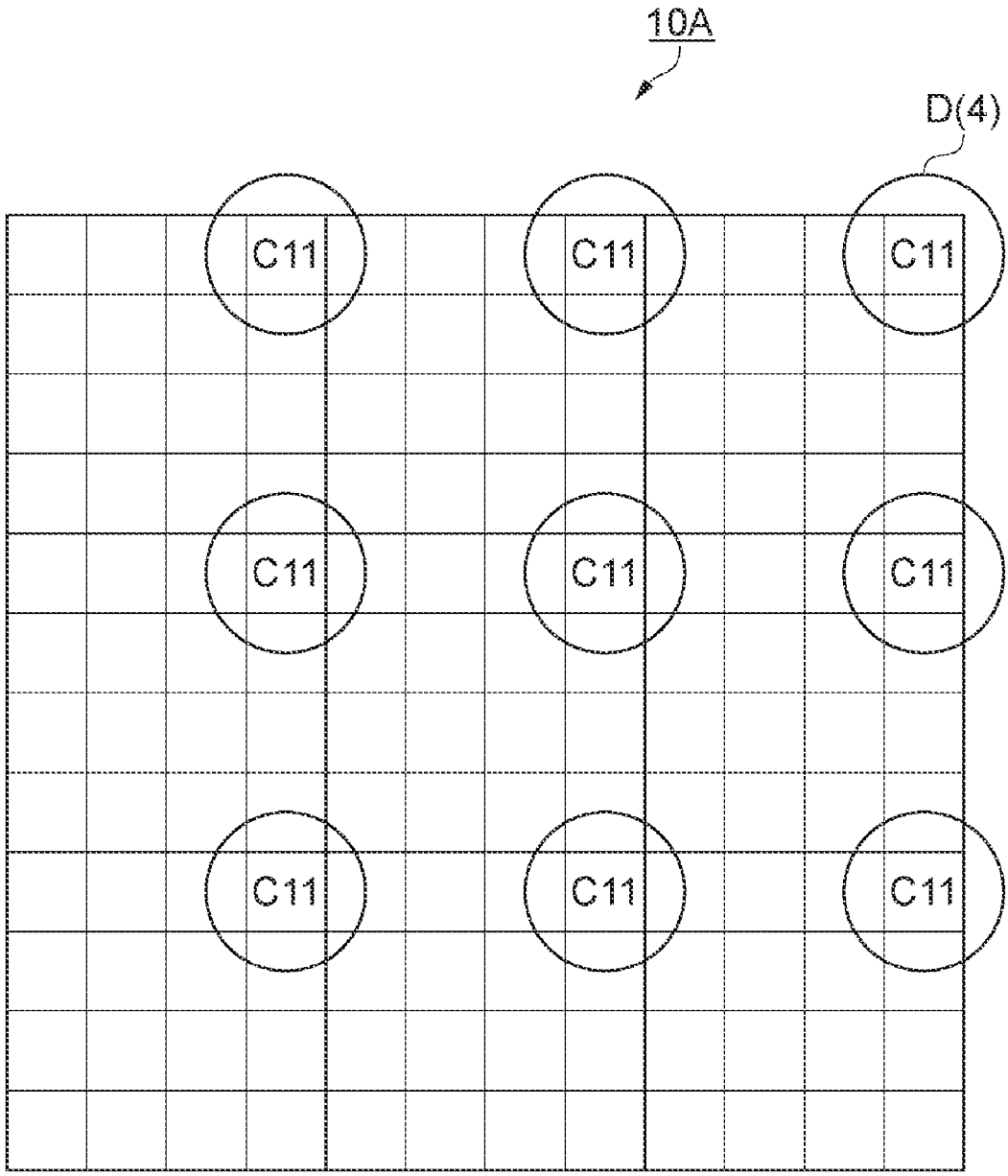
FIG. 8 is a diagram explaining a step of arranging droplets on C11.

Next, as shown in FIG. 8, one droplet D is arranged on each of the plurality of C11 within the layer formation range. In other words, in each of the plurality of block groups 1G, the droplet D is arranged on one of the four blocks 1 that correspond to the four corners. The first droplet D to be arranged within the range corresponding to one block group 1G is also referred to as a "base dot".

Details of the step of arranging the droplet D in C11 is as follows.

In the embodiment, the droplet D is arranged on all C11 within the layer formation range using the plurality of nozzles 118 in the nozzle row 116. More specifically, the head 114 is positioned to the stage 106 so that the X coordinate of a certain nozzle 118 and the X coordinate of C11 in a certain column match. For example, with reference once again to FIG. 6, the X coordinate of the right-most nozzle 118 on the paper and the X coordinate of C11 in the right-most column are matched. Then, while maintaining the X coordinate of the head 114, the stage 106 is relatively moved in the scanning direction (Y axis direction). As a result, the certain nozzle 118 faces each of the plurality of C11 in the column. Then, when the droplets D are discharged from the nozzles 118 at an appropriate timing, the droplets D are arranged on the plurality of C11 in the column. The "column" described here refers to a set of blocks 1 that are aligned in a row in the scanning direction (Y axis direction).

Next, the head 114 is relatively moved in the N axis direction so that the X coordinate of another nozzle 118 and the X coordinate of C11 in another column match. For example, the X coordinate of the nozzle 118 that is second from the right and the X coordinate of C11 in the fourth column from the left are matched (the X coordinates are not matched yet in FIG. 6). Then, as in the foregoing column, while maintaining the X coordinate of the head 114, the stage 106 is relatively moved in the scanning direction (Y axis direction). As a result, the certain nozzle 118 faces each of the plurality of C11 in the column. Then, when the droplets D are discharged from the nozzles 118 at an appropriate timing, the droplets D are arranged on the plurality of C11 in the column.

As is clear from the description above, when the droplet D is arranged on C11, the same nozzle 118 is assigned to all of the plurality of C11 belonging to the same column in the array composed of C11. However, when the column changes, the assigned nozzle 118 may change.

Returning to FIG. 8, as described above, the impact diameter of the droplet D is 30 μm. Therefore, when the droplet D is arranged on C11, the droplet D spreads within a range of 15 μm from the center of C11. As a result, the dot pattern 4 is obtained. Here, the distance between the centers of two C11 mutually adjacent in the X axis direction is 44 μm. The distance between the centers of two C11 mutually adjacent in the Y axis direction is 60 μm. Furthermore, the distance between the centers of two C11 mutually adjacent in the composite direction U of the X axis direction and the Y axis direction is approximately 74.4 μm. Therefore, the dot pattern 4 on an arbitrary C11 is not in contact with any dot pattern 4 on an adjacent C11. In other words, the dot pattern 4 on an arbitrary C11 is separated from the dot patterns 4 on all adjacent C11.

As a result of such a step, a plurality of dot patterns 4 is aligned separately and in an array determined in the X axis direction and the Y axis direction. The plurality of C11 and the plurality of dot patterns 4 correspond. Therefore, the number of C11 and the number of dot patterns 4 are the same.

C11 is an example of the "reference region" in the invention.

3B. Base Dot Fixing Step

After the droplets D are arranged on all C11 within the layer formation range, the droplet D on each of the plurality of C11 is fixed. In other words, a plurality of dot-shaped patterns 4 are fixed onto the corresponding C11. Specifically, the dot-shaped patterns 4 are dried so that the solvent (or carrier fluid) evaporates from the functional fluid 111 forming the dot-pattern 4. In the embodiment, hot air from a dryer is blown onto the dot-shaped pattern 4. Ordinarily, the functional fluid 4 moves easily on a surface having repellency. However, in the embodiment, the dot-shaped pattern 4 composed of the functional fluid 111 is dried in this way, and therefore, the dot-shaped pattern 4 looses fluidity. Therefore, the dot-shaped pattern 4 is fixed onto C11. As a result, the possibility of the dot-shaped pattern 4 on C11 being attracted to C31, C13, or C33 becomes low, even when the dot-shaped pattern 4 comes into contact with the respective droplets D subsequently arranged on C31, C13, and C33. Thus, the possibility of a hole being formed in the finally acquired electrical conducting layer 8 (see FIG. 11) is low.

3C. Develop Lyophilic Properties

Next, although not shown, the surface of the substrate 10A is made lyophilic. In the embodiment, the droplet D is arranged on the fixed dot-shaped pattern 4. In other words, another droplet D is arranged once again on each of the plurality of C11. Then, C31 becomes lyophilic to the droplet D subsequently arranged on C31. As a result, even when the droplet D arranged on C31 comes into contact with the dot-shaped pattern 4 on C11, the possibility of the droplet D arranged on C31 being attracted to C11 becomes low. Therefore, the possibility of a hole being formed in the finally acquired electrical conducting layer 8 is low. The mechanism by which the surface of the substrate 10A (C31) becomes lyophilic by the droplet D being arranged once again on C11 is not sufficiently understood. However the inventors currently speculate that a solvent atmosphere created by the droplet D that has been arranged once again contributes to the development of lyophilic properties in the substrate 10A or C31.

Here, the volume of the droplet D that is once again arranged on C11 may be smaller than the volume of the droplet D that has initially been arranged on C11. Specifically, a droplet D having a volume that allows the dot-shaped pattern 4 on C11 to remain separated from the dot-shaped pattern 4 on the adjacent C11, in addition to allowing C31 to develop lyophilic properties, may be one again arranged on C11. The volume of the droplet D that is once again arranged on C11 may also be equal to or larger than the volume of the droplet D that has initially been arranged on C11.

When the substrate 10A becomes lyophilic to the functional fluid 111 to a certain degree, the step of developing lyophilic properties may be omitted.

3D. First Connection Dot Arrangement Step

Next, the impact diameter of the droplet D that is discharged from the droplet discharging device 100 is set to 32 μm. In other words, the driving signal DS (see FIG. 5B) of the droplet discharging device 100 is changed so that a droplet D having a volume that is larger than the volume of the droplet D arranged on C11 is discharged. Details of the technology used to change the driving signal DS (namely, technology for actualizing a variable dot) is described in FIG. 5 to FIG. 8 in JP-A-2001-58433. Therefore, descriptions thereof are omitted.

Figure 9:
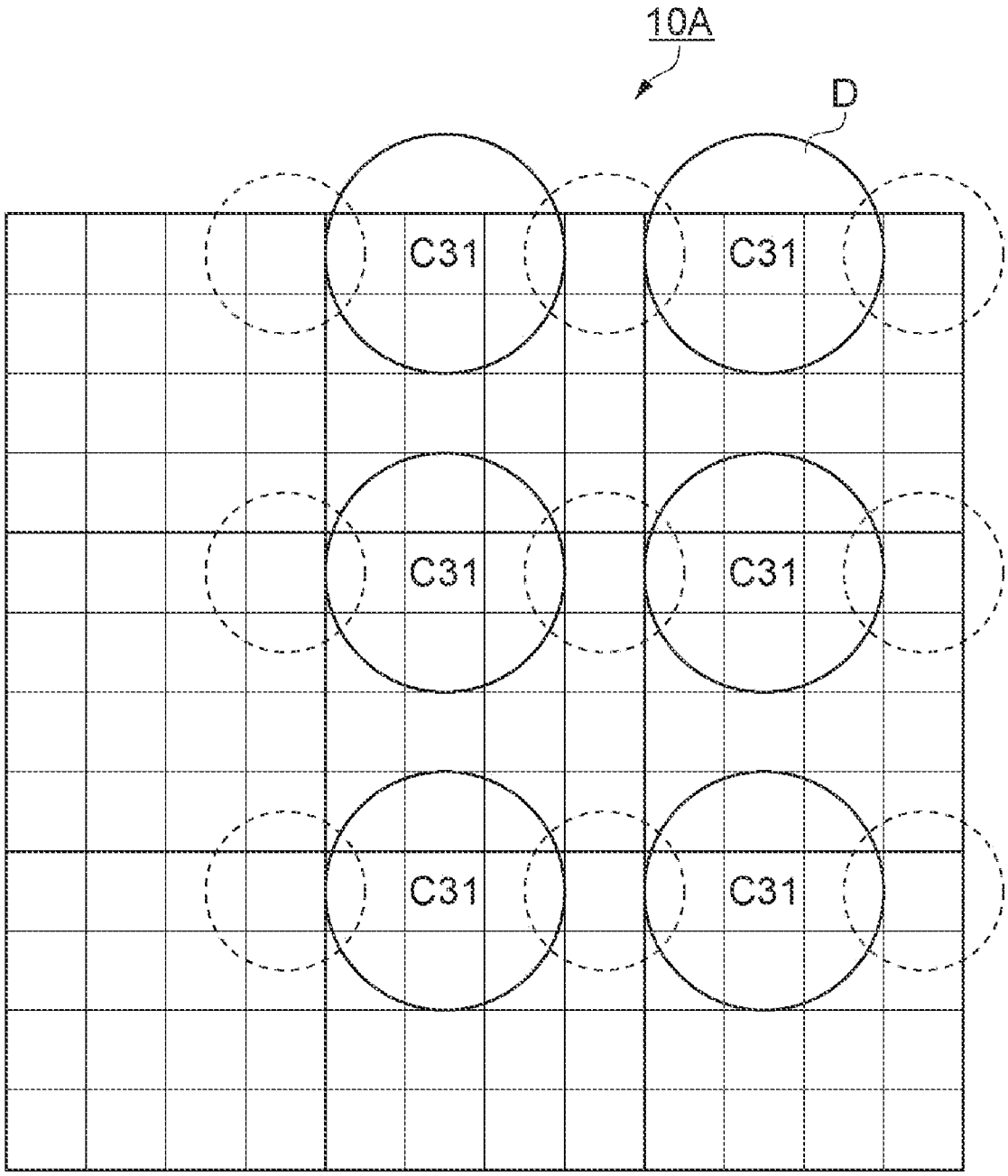
FIG. 9 is a diagram explaining a step of arranging droplets on C31.

Next, as shown in FIG. 9, one droplet D is arranged on each of the plurality of C31 within the layer formation range. At this time the droplet D is arranged so that the center of the droplet D is positioned in the center of C31. Here, C31 is halfway between two C11 that are adjacent in the X axis direction. Therefore, the distance between C31 and C11 that is the closest to C31 is 22 μm. In addition, the dot-shaped pattern 4 on C11 spreads within a range of 15 μm from the center of C11. At the same time, because the droplet D on C31 spreads within a range of 16 μm from the center of C31, the droplet D arranged on C31 is in contact with the dot-shaped pattern 4 on C11. In the specification, the droplets D that are, arranged on C31, C13, and C33 are also referred to as "connection dots".

Further details of the step of arranging the droplet D on C31 is as follows.

In the embodiment, the droplets D are arranged on all C31 within the layer forming range using the plurality of nozzles 118 in the nozzle row 116. More specifically, as in the step of arranging the droplets D on C11, the head 114 is positioned to the stage 106 so that the X coordinate of a certain nozzle 118 and the X coordinate of C31 in a certain column match. Then, while maintaining the X coordinate of the head 114, the stage 106 is relatively moved in the scanning direction (Y axis direction). As a result, the certain nozzle 118 faces each of the plurality of C31 in the column. When the droplets D are discharged from the nozzle 118 at an appropriate timing, the droplets D are arranged on each of the plurality of C31 in the column.

Next, the head 114 is relatively moved in the X axis direction so that the X coordinate of another nozzle 118 and the X coordinate of C(31 in another column match. Then, as in the foregoing column, while maintaining the X coordinate of the head 114, the stage 106 is relatively moved in the scanning direction (Y axis direction) and the respective droplets D are arranged on each of the plurality of C31 in the column.

As is clear from the description above, when the droplet D is arranged on (131, the same nozzle 118 is assigned to all of the plurality of C31 belonging to the same column, in the array composed of C31. However, when the column changes, the assigned nozzle 118 may change.

Figure 10:
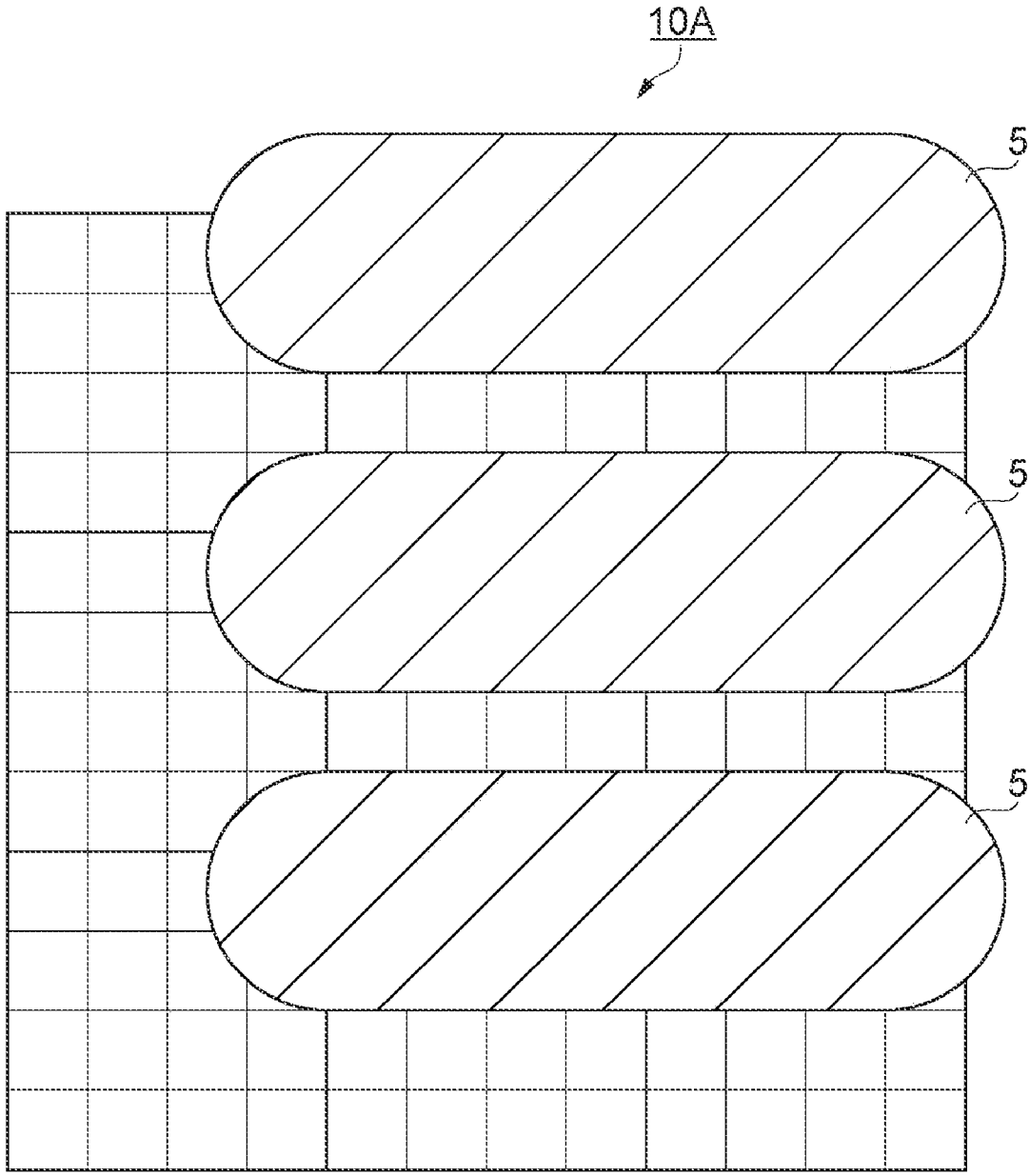
FIG. 10 is a schematic view of line-shaped patterns acquired after the droplets are arranged on C31.

In this way, in this step, the droplet D is arranged on C31 positioned in the X axis direction to C11. As a result, the dot-shaped pattern 4 extends in the X axis direction. Furthermore, in this step, the plurality of dot-shaped patterns 4 that are aligned in the X axis direction is connected in the X axis direction. Then, when the arrangement of the droplets D in all C31 within the layer formation range is completed, as shown in FIG. 10, a plurality of line-shaped patterns 5 composed of the droplets D arranged on C11 and the droplets D arranged on C31 appear. Each of the plurality of line-shaped patterns 5 extends in the X axis direction and is mutually separate.

3E. Second Connection Dot Arrangement Step

Figure 11:
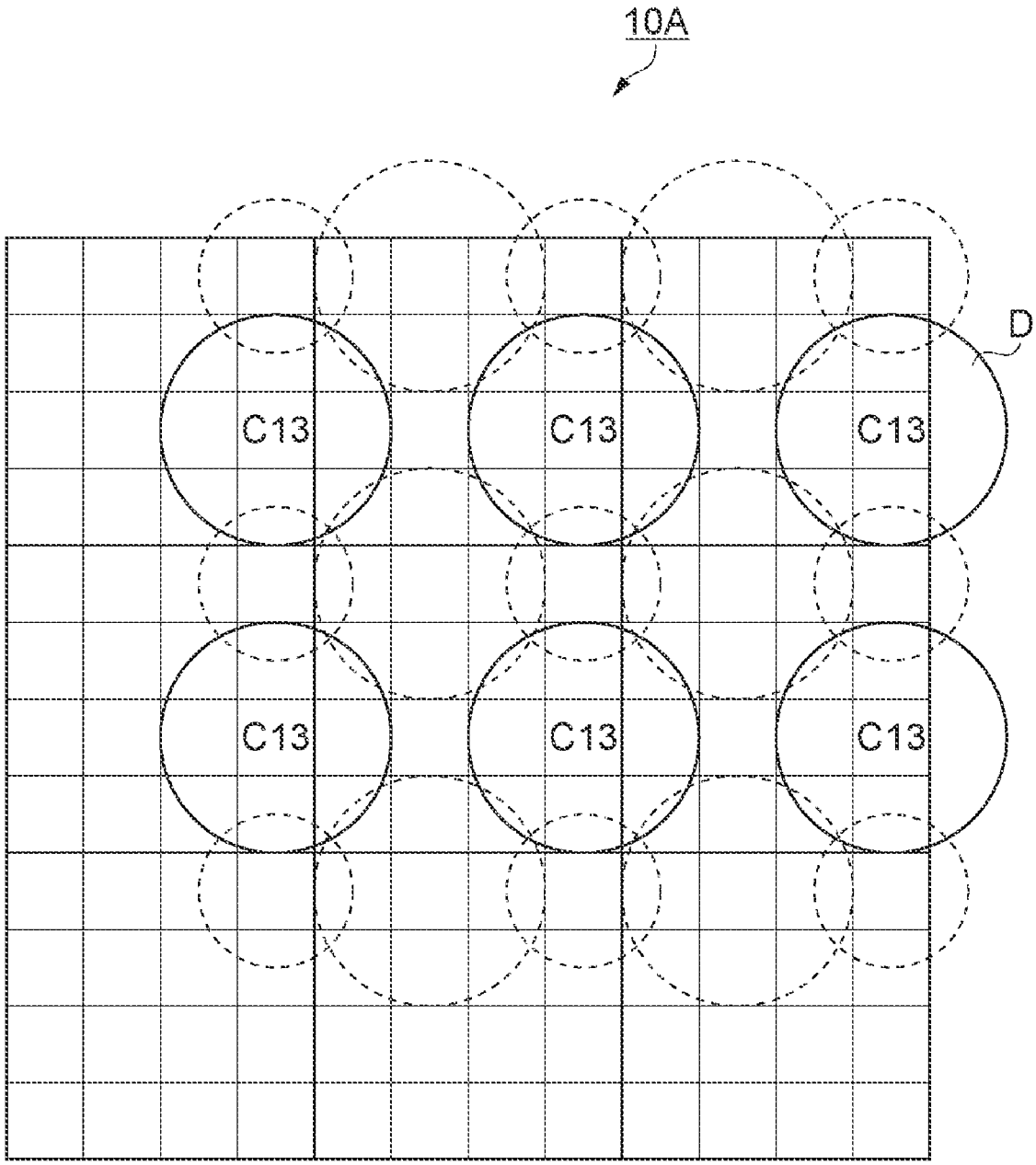
FIG. 11 is diagram explaining a step of arranging droplets on C13.

After the droplets D are arranged on all C31 within the layer formation range, the impact diameter of the droplet D discharged from the droplet discharging device 100 is set to 32 μm. Then, as shown in FIG. 11, one droplet D is respectively arranged on each of the plurality of C13 within the layer formation range. At this time, the droplet D is arranged so that the center of the droplet D is positioned in the center of C13. Here, C13 is halfway between two adjacent C11 in the Y axis direction. Therefore, the distance between C13 and C11 that is the closest to C13 is 30 μm. Then, the droplet D arranged on C11 spreads within a range of 15 μm from the center of C11. At the same time, because the droplet D spreads on C13 within a range of 16 μm from the center of C13, the droplet D that is arranged on C13 is in contact with the line-shaped pattern 5.

Further details of the step of arranging the droplet D on C13 are as follows.

In the embodiment, the droplets D are arranged on all C13 within the layer formation range using the plurality of nozzles 118 in the nozzle row 116. More specifically, as in the step of arranging the droplets D on C11, the head 114 is positioned to the stage 106 so that the X coordinate of a certain nozzle 118 and the X coordinate of C13 in a certain column match. Then, while maintaining the X coordinate of the head 114, the stage 106 is relatively moved in the scanning direction (Y axis direction). As a result, the certain nozzle 118 faces each of the plurality of C31 in the column. Then the droplets D are discharged from the nozzle 118 at an appropriate timing, the droplets D are arranged on each of the plurality of C13 in the column.

Next, the head 114 is relatively moved in the X axis direction so that the X coordinate of another nozzle 118 and the X coordinate of C13 in another column match. Then, as in the foregoing column, while maintaining the X coordinate of the head 114, the stage 106 is relatively moved in the scanning direction (Y axis direction) and the respective droplets D are arranged on each of the plurality of C13 in the column.

As is clear from the description above, when the droplet D is arranged on C31, the same nozzle 118 is assigned to all of the plurality of C13 belonging to the same column, in the array composed of C63. However, when the column changes, the assigned nozzle 118 may change.

Figure 12:
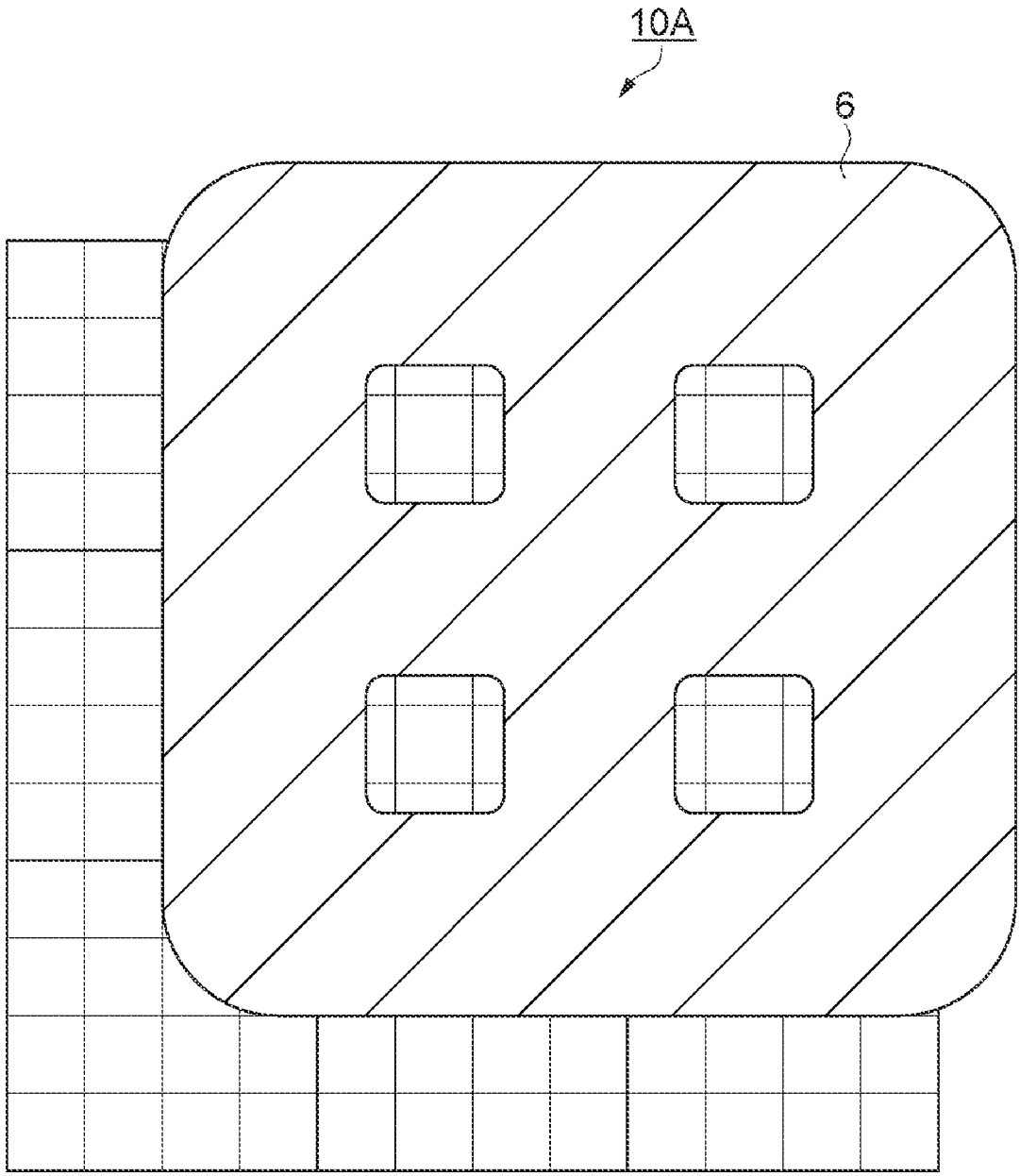
FIG. 12 is a schematic view of a lattice-shaped pattern acquired after the droplets are arranged on C13.

In this way, in this step, the droplet D is arranged on C13 that is positioned in the Y axis direction to C11. As a result, each of the plurality of line-shaped patterns 5 extends in the Y axis direction. Furthermore, in this step, the plurality of line-shaped patterns 5 is connected in the Y axis direction. Then, as shown in FIG. 12, when the arrangement of the droplet D in all C13 within the layer formation range is completed, a lattice-shaped pattern 6 composed of the droplets D arranged on C11, the droplets D arranged on C31, and the droplets D arranged on C13 appears.

3F. Third Connection Dot Arrangement Step

Figure 13:
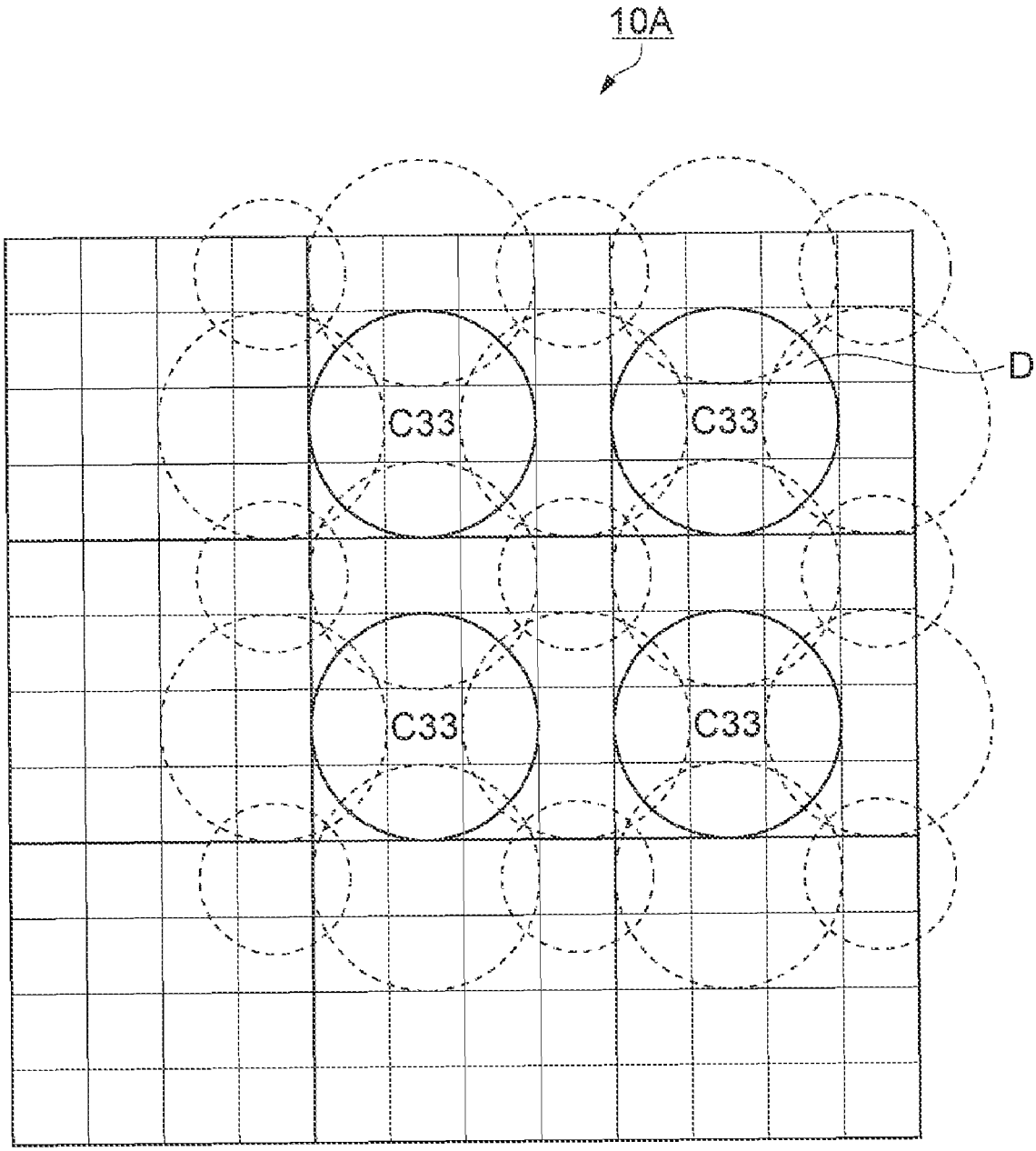
FIG. 13 is diagram explaining a step of arranging droplets on C33.

After the droplets D are arranged on all C13 within the layer formation range, the impact diameter of the droplet D discharged from the droplet discharging device 100 is set to 32 μm. Then, as shown in FIG. 13, one droplet D is respectively arranged on each of the plurality of C33 within the layer formation range. At this time, the droplet D is arranged so that the center of the droplet D is positioned in the center of C33. Here, C33 is halfway between two adjacent C11 in the composite direction U of the X axis direction and the Y axis direction. The droplets D arranged on C33 fill the holes in the lattice-shaped pattern 6 formed from already arranged droplets D. As a result, the lattice-shaped pattern 6 formed from already arranged droplets D extends in the composite direction U, because of the arrangement of the droplets D on C33.

Further details of the step of arranging the droplets D on C33 are as follows.

In the embodiment, the droplets D are arranged on all C33 within the layer formation range using the plurality of nozzles 118 in the nozzle row 116. Specifically, as in the step of arranging the droplets D on C11, the head 114 is positioned to the stage 106 so that the X coordinate of a certain nozzle 118 and the X coordinate of C33 in a certain column match. Then, while maintaining the X coordinate of the head 114, the stage 106 is relatively moved in the scanning direction (Y axis direction). As a result, the certain nozzle 118 faces each of the plurality of C33 in the column. When the droplets D are discharged from the nozzle 118 at an appropriate timing, the droplets D are arranged on each of the plurality of C33 in the column.

Next, the head 114 is relatively moved in the X axis direction so that the X coordinate of another nozzle 118 and the X coordinate of C33 in another column match. Then, as in the foregoing column, while maintaining the X coordinate of the head 114, the stage 106 is relatively moved in the scanning direction (Y axis direction) and the respective droplets D are arranged on each of the plurality of C33 in the column.

As is clear from the description above, when the droplet D is arranged on C33, the same nozzle 118 is assigned to all of the plurality of C33 belonging to the same column, in the array composed of C33. However, when the column changes, the assigned nozzle 118 may change.

Figure 14:
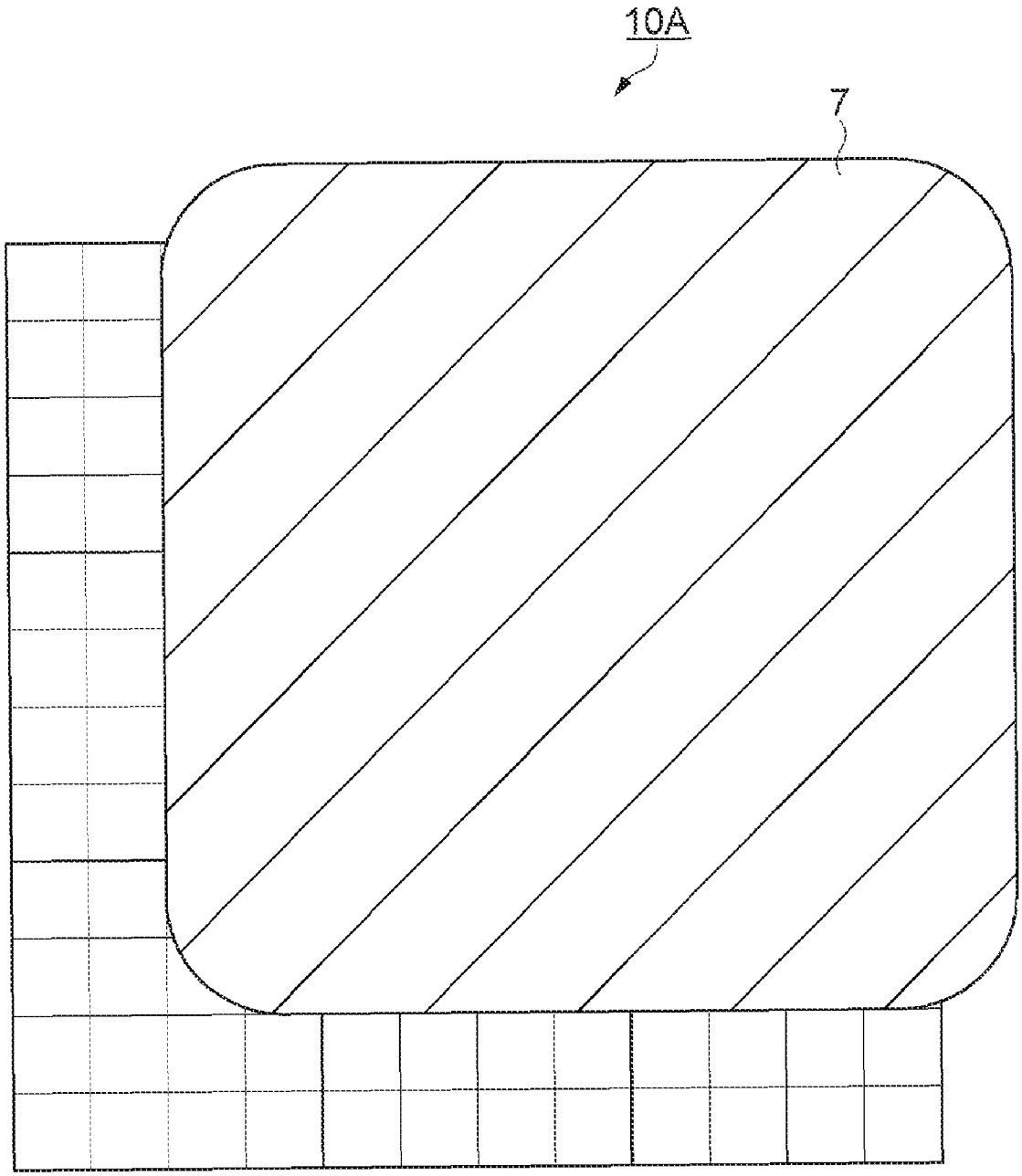
FIG. 14 is a schematic view of a solid pattern acquired after the droplets are arranged on C33.

When the arrangement of the droplets D in all C33 within the layer formation range is completed, as shown in FIG. 14, a solid pattern 7 composed of the droplets D arranged on C11, the droplets D arranged on C31, the droplets D arranged on C13, and the droplets D arranged on C33 appears. In the embodiment, the layer formation range corresponding to 9 blocks×9 blocks on the surface of the substrate 10A is covered by the solid pattern 7 without any gaps. As described above, because the droplets D spread on the surface, the area covered by the solid pattern 7 (area of the layer formation range) is slightly larger than the area of 9 blocks×9 blocks.

In this way, respective droplets D are sequentially arranged on each of the plurality of block groups 1G, from C11, C31, C13, to C33. As a result: for example, even if the surface of the substrate 10A has repellency, a solid pattern 7 that is respectively continuous in the X axis direction, the Y axis direction, and the composite direction U is formed by the droplets D arranged on the four blocks 1. In other words, a hole-less solid pattern 7 is formed.

3G. Activation Step

Figure 15:
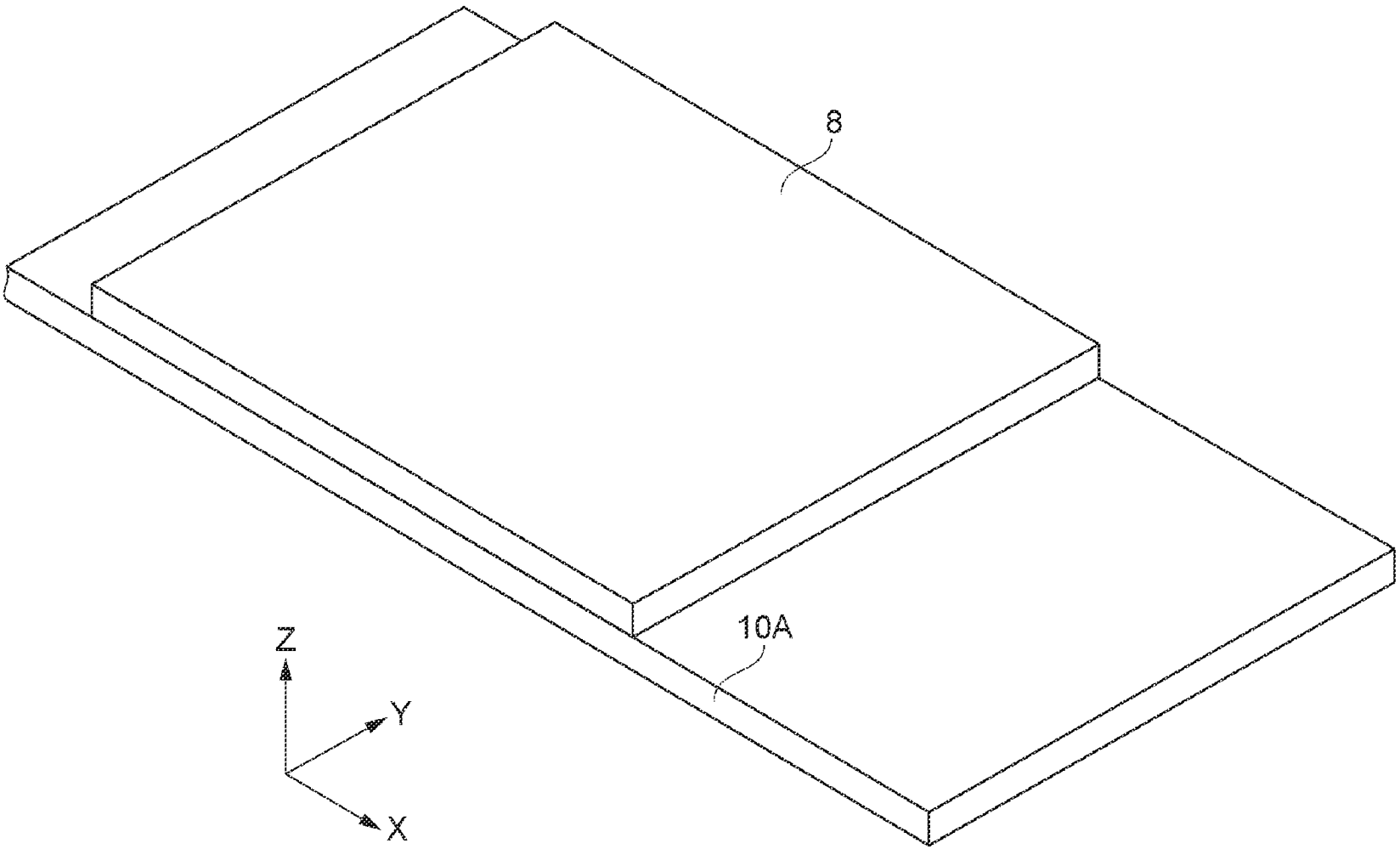
FIG. 15 is a schematic view of an electrical conducting layer acquired by activating the solid pattern in FIG. 14.

Next, the solid pattern 7 is activated. Specifically, the solid pattern 7 is heated so that the silver particles in the solid pattern 7 are sintered or fused. Then, the solid pattern 7 develops electrical conductivity due to the sintered or fused silver particles, and as a result, an electrical conducting layer 8 such as that shown in FIG. 15 is acquired.

Figure 16:
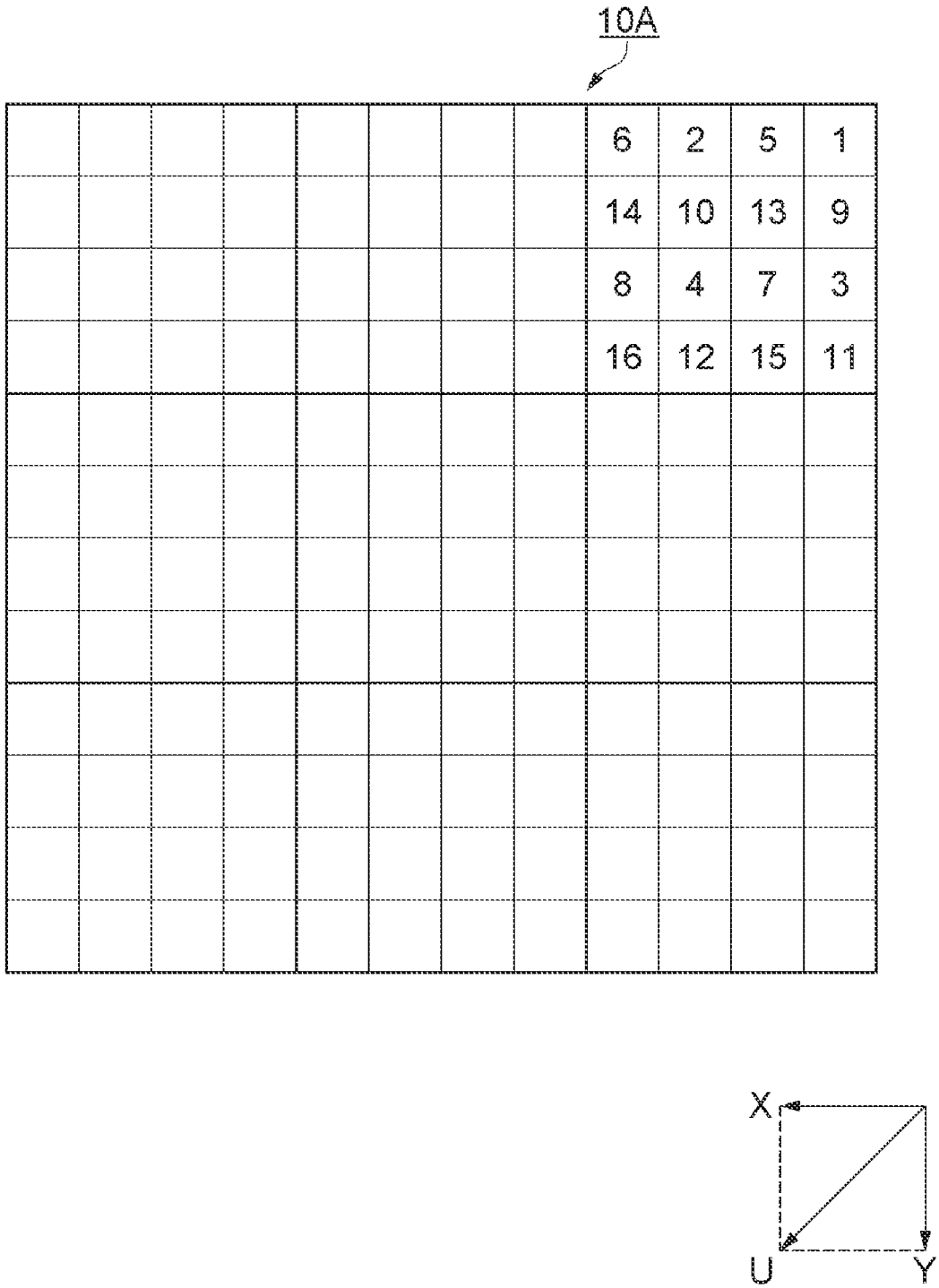
FIG. 16 is a diagram showing another order in which the droplets are arranged on the blocks.

When the thickness of the acquired electrical conducting layer 8 is not sufficiently even, 12 droplets D may be further arranged on each block group 1G, as shown in FIG. 16. Specifically, in addition to the 4 blocks, C11, C31, C13, and C33, the droplets D can be respectively and sequentially arranged on 12 blocks, from C21, C41, C23, C43, C12, C32, C14, C34, C22, C42, C24, to C44. In other words, the droplets D may be arranged on all blocks 1 in the block group 1G. As a result, an electrical conductive layer 8 with a more even thickness can be acquired. The volumes of the 12 additionally arranged droplets D may be smaller than the volumes of the 4 already arranged droplets D.

In this way, according to the embodiment, first, the plurality of dot-shaped patterns is arranged on the substrate 10A. Then, the plurality of line-shaped patterns 5 extending in the X axis direction appears. Subsequently, the plurality of line-shaped patterns 5 is connected in the Y axis direction and the lattice-shaped pattern 6 appears. Finally, the droplets D are arranged on the remaining spaces and a two-dimensional, continuous solid pattern 7 is formed. Then, the hole-less electrical conducting layer 8 is acquired by activating the solid pattern 7.

As long as the arrangement order of the droplets D within the block group 1G is as described above, the order between a plurality of block groups 1G is not restricted in any way. For example, a plurality of block groups 1G that form a row extending in the X axis direction may be processed almost simultaneously. Similarly, a plurality of block groups 1G that form a row extending in the ET axis direction may be processed almost simultaneously. In addition, the plurality of block groups 1G may be sequentially processed, one block group 1G at a time.

As is clear from the description above, in the method for forming a layer according to the embodiment, upon the completion of the arrangement of the droplets D in the first two types of blocks 1, the plurality of separate line-shaped patterns 5 extending in the X direction is formed. Specifically, at least one of 1) the order in which droplets D are arranged, 2) the size of the block 1, 3) the number of block 1 included in the block group 1G, and 4) the impact diameter of the droplet D is set so that such a line-shaped pattern 5 is acquired. In an experiment performed by the inventors, when a plurality of separate line-shaped patterns 5 extending in a direction (X axis direction) perpendicular to the scanning direction can be acquired in this way, the possibility of acquiring a favorable solid pattern 7 is high. In the embodiment, the first two types of blocks 1 are C11 and C31.

As described above, when the droplets D are arranged on a plurality of blocks 1 in one column, one nozzle 118 is assigned to one column. Therefore, even if the discharge path varies between the plurality of nozzles 118, the distances between the arranged droplets D along the scanning direction are constant. In this case, the distance between the arranged droplets D along the scanning direction is determined by an integral multiple of the product of the discharging cycle EP (see FIG. 5B) and relative moving velocity of the stage 106.

At the same time, when the droplets D are arranged on a plurality of blocks 1 in one row, a plurality of nozzles 118 is assigned to one row. Here, the "row" refers to a set of blocks 1 aligned in a row in the X axis direction. Because the plurality of nozzles 118 is assigned in this way, when the discharge paths between the plurality of nozzles 118 vary, the distances between the arranged droplets D in the X axis direction may not be constant. It goes without saying that the head 114 is adjusted so that such variations in discharge paths in the X axis direction fall within a permissible range. However, even then, the variations in the discharge paths in the X axis direction may change with time due to build-up of the functional fluid 111 within the nozzle 118 and the like. Incidental bending of the discharge path may also occur. When such variations in the discharge path in the X axis direction occur, the dots obtained by the arranged droplets D may not connect in the X axis direction. As a result, the line-shaped pattern 5 may not be acquired.

Therefore, in the process of forming the solid pattern 7, it is preferable that the acquisition of the plurality of separate line-shaped patterns 5 extending in the X axis direction can be confirmed. In the method for forming a layer according to embodiment, upon completion of the arrangement of the droplets D in the first two types of blocks 1, the line-shaped pattern 5 extending in the X axis direction is acquired. If the line-shaped pattern 5 is not acquired upon completion of the arrangement of the droplets D in the first two types of blocks 1, the substrate 10A is labeled as a defective product. However, even when the substrate 10A becomes a defective product because the line-shaped pattern 5 is not acquired, the arrangement of the droplets D in the remaining two types of blocks 1 not yet performed. Therefore, wasteful consumption of the functional fluid 111 can be reduced.

MODIFIED EXAMPLE 1

In the embodiment, after the dot-shaped pattern 4 is dried onto C11, the surface of C31 is made lyophilic by once again arranging the droplet D on C11. However, the invention is not limited thereto. Specifically, after the droplet D is dried onto C11, C31 may be made lyophilic by exposing the surface of the substrate 10A to oxygen plasma, or C31 may be made lyophilic by irradiating a wavelength in the ultraviolet region onto the surface of the substrate 10A.

MODIFIED EXAMPLE 2

The functional fluid in the embodiment includes silver nano particles. However, nano particles of other metals can be used in place of the silver nano particles. Here, any one of for example, gold, platinum, copper, palladium, rhodium, osmium, ruthenium, iridium, iron, tin, zinc, cobalt, nickel, chromium, titanium, tantalum, tungsten, and indium may be used as the other metal. Alternatively, an alloy that is a combination of any two or more of the above can also be used. However, silver can be reduced at a comparatively low temperature, and therefore, is easy to handle. From this perspective, it is preferable to use functional fluid including silver nano particles when using the droplet discharging device.

In addition, the functional fluid can include organic metallic compounds in place of metal nano particles. The organic metallic compounds are compounds from which metal is deposited by decomposition caused by heat. Chlorotriethylphosphine gold (I), chlorotrimethylphosphine gold (I), chlorotriplhenylephosphine gold (I), silver (I), 2,4-pentanedionate complex, trimethylphosphine (hexafluoroacetylacetonato) silver (I) complex, copper (I) hexafluoropentanedionate cyclooctadiene complex, and the like are such organic metallic compounds.

In this way, the form of the metal included in the functional fluid may be a particle represented by the nano particle or may be a compound such as the organic metallic compound.

Furthermore, the functional fluid can include soluble material of conducting polymer, such as polyaniline, polythiophene, polyphenylene vinylene, poly (3,4-ethylenedioxythiophene) (PEDOT), in place of the metal.

MODIFIED EXAMPLE 3

In the embodiment, the solid electrical conducting layer 8 is formed. However, the invention is not limited thereto. For example, the invention can be applied as a method for forming a solid insulating layer. When forming the solid insulating layer, a functional fluid including insulating material is prepared. Here, such a functional fluid preferably includes a photopolymerizable insulating resin as the insulating layer and an organic solvent that dissolves the insulating resin. When the functional fluid includes such an insulating material, the above-described fixing step and activation step are a step of irradiating light onto a dot-shaped pattern or a solid pattern formed from the functional fluid or a step of heating the dot-shaped pattern or the solid pattern, so that both steps harden the insulating resin.

MODIFIED EXAMPLE 4

According to the embodiment, the droplets D are arranged on the substrate 10A composed of polyimide. However, effects similar to those described in the embodiment may be acquired even when a ceramic substrate, a glass substrate, an epoxy substrate, a glass epoxy substrate, a silicon substrate, or the like is used in place of such a substrate 10A. In addition, the surface onto which the droplets D are arranged is not limited to the surface of the substrate. The surface may also be a surface of an almost flat insulating layer or an almost flat electrical conducting layer.

MODIFIED EXAMPLE 5

The size of the block 1, the number of blocks 1 included in the block group 1G, and the impact diameter of the droplet D in the above-described embodiment are not limited to the values in the embodiment. Specifically, at least one of the size of the block 1, the number of blocks 1 included in the block group 1G, and the impact diameter of the droplet D is set so that the dot-shaped pattern 4 on an arbitrary C11 is separated from the dot-shaped patterns 4 on all adjacent C11.

MODIFIED EXAMPLE 6

According to the embodiment, the impact diameter of the droplet D arranged on C31, the impact diameter of the droplet D: arranged on C13, and the impact diameter of the droplet D arranged on C33 are all the same. However, in place of such a configuration, the impact diameters can vary so that an electrical conducting layer 8 having a more even thickness may be acquired. When varying the impact diameters of the droplet D, the volume of the discharged droplets D are changed.

MODIFIED EXAMPLE 7

Surface improving process can be performed on the surface of the substrate 10A prior to arranging the droplets on C11, C31, C13, and C331 so that the degree of repellency of the surface to be the foundation is increased. As a result, the shape of the edges of the solid pattern 7 becomes sharper. As a process for improving the repellency of the surface, formation of a fluoroalkylsilane (FAS) film on the surface of the substrate 10A is known. In addition, the repellency of the surface can also be improved by exposing the surface to processing gas according to an atmospheric pressure plasma method, using processing gas including fluorine.

What is claimed is:

1. A method for forming a layer using a droplet discharging device that discharges droplets from a plurality of nozzles while relatively moving a surface in a first direction with respect to a head including the plurality of nozzles, the method for forming a layer comprising:

a) respectively arranging a first droplet on each of a plurality of reference regions aligned on the surface in an array determined in the first direction and a second direction perpendicular to the first direction and providing a plurality of separate patterns corresponding to the plurality of reference regions;

b) fixing the plurality of patterns;

c) respectively arranging a second droplet between each of the plurality of reference regions aligned in the second direction and connecting the plurality of patterns in the second direction, after fixing the plurality of patterns;

d) respectively arranging a third droplet between each of the plurality of reference regions aligned in the first direction and connecting the plurality of patterns in the first direction, after respectively arranging the second droplet between each of the plurality of reference regions aligned in the second direction and connecting the plurality of patterns in the second direction; and e) arranging a fourth droplet between each of the reference regions aligned in a composite direction of the first direction and the second direction, after respectively arranging a third droplet between each of the plurality of reference regions aligned in the first direction and connecting the plurality of patterns in the first direction.

2. The method for forming a layer according to claim 1, further comprising:

f) activating the pattern after arranging the fourth droplet between each of the reference regions aligned in the composite direction of the first direction and the second direction.

3. The method for forming a layer according to claims 1, wherein:

at least one of the volume of a single second droplet, the volume of a single third droplet, and the volume of a single fourth droplet differs from the volume of a single first droplet.

4. The method for forming a layer according to claim 1, further comprising:

f) making the surface lyophilic between fixing the plurality of patterns, and respectively arranging the second droplet between each of the plurality of reference regions aligned in the second direction and connecting the plurality of patterns in the second direction.

5. The method for forming a layer according to claim 4, wherein the step f) includes irradiating ultraviolet rays onto the surface or exposing the surface to plasma.

6. The method for forming a layer according to claim 5, wherein:

the step f) includes respectively arranging a fifth droplet on each of the plurality of patterns.

7. The method for forming a layer according to claim 6, wherein at least one of the volume of a single second droplet, the volume of a single third droplet, the volume of a single fourth droplet, and the volume of a single fifth droplet differs from the volume of a single first droplet.

* * * * *